US011047085B2

(12) United States Patent
Dal Molin et al.

(10) Patent No.: US 11,047,085 B2
(45) Date of Patent: Jun. 29, 2021

(54) LAUNDRY DRYER COMPRISING A FILTER ASSEMBLY AND A METHOD TO CLEAN A FILTER ASSEMBLY

(71) Applicant: Electrolux Appliances Aktiebolag, Stockholm (SE)

(72) Inventors: Rudy Dal Molin, Porcia (IT); Michael Edenius, Porcia (IT); Nadir Mazzarotto, Porcia (IT); Gabriele Missio, Porcia (IT); Nicola Reid, Porcia Pordenone (IT); Giuseppe Rossi, Porcia (IT)

(73) Assignee: Electrolux Appliances Aktiebolag

( * ) Notice: Subject to any disclaimer, the term of this patent is extended or adjusted under 35 U.S.C. 154(b) by 87 days.

(21) Appl. No.: 16/473,344

(22) PCT Filed: Dec. 29, 2016

(86) PCT No.: PCT/EP2016/082888

§ 371 (c)(1),
(2) Date: Jun. 25, 2019

(87) PCT Pub. No.: WO2018/121871

PCT Pub. Date: Jul. 5, 2018

(65) Prior Publication Data

US 2020/0123697 A1 Apr. 23, 2020

(51) Int. Cl.
*F26B 21/06* (2006.01)
*D06F 58/22* (2006.01)

(52) U.S. Cl.
CPC ..... *D06F 58/22* (2013.01)

(58) Field of Classification Search
CPC ..... D06F 58/22
(Continued)

(56) References Cited

U.S. PATENT DOCUMENTS 8,789,287 B2 7/2014 Kim et al.
2006/0201014 A1* 9/2006 Favret ..... D06F 58/22 34/82

(Continued)

FOREIGN PATENT DOCUMENTS

EP 2055825 A1 5/2009
EP 2226421 A1 9/2010

(Continued)

OTHER PUBLICATIONS

International Search Report and Written Opinion for International Application No. PCT/EP2016/082888, dated Feb. 14, 2017, 9 pages.

(Continued)

*Primary Examiner* — John P McCormack
(74) *Attorney, Agent, or Firm* — RatnerPrestia

(57) ABSTRACT

A laundry dryer having a cabinet, a rotatable drum, a duct defining a flow passage for process air, and a filter assembly positioned in the duct. The filter assembly includes a frame, a filter surface, and a cleaning device. The cleaning device includes wiper seat, a wiper, and a handle portion connected to the wiper portion. The cleaning device is pivotally attached to the frame to rotate around an axis, to be movable from a first resting position in which the handle is substantially completely housed in the wiper seat, to a plurality of wiping positions in which the wiper portion wipes the first filtering surface. In at least in one of the wiping positions, the handle portion protrudes from the wiper seat, and the handle portion is operable to perform the transition from the first resting position to any of the wiping positions.

21 Claims, 14 Drawing Sheets

(58) Field of Classification Search
USPC ..... 34/82, 480
See application file for complete search history.

(56) References Cited

U.S. PATENT DOCUMENTS

| | | | | |
|---|---|---|---|---|
| 2011/0225837 | A1 | 9/2011 | Ahn et al. | |
| 2011/0271542 | A1 | 11/2011 | Ko et al. | |
| 2014/0109427 | A1* | 4/2014 | Kim | D06F 58/22 34/85 |
| 2014/0182157 | A1 | 7/2014 | Lee et al. | |

FOREIGN PATENT DOCUMENTS

| | | | |
|---|---|---|---|
| EP | 2749689 | A1 | 7/2014 |
| JP | 0549795 | A | 3/1993 |
| JP | 2008194439 | A | 8/2008 |
| JP | 4245653 | B1 | 3/2009 |
| JP | 2010022677 | A | 2/2010 |
| WO | 2016095970 | A1 | 6/2016 |

OTHER PUBLICATIONS

International Search Report and Written Opinion for International Application No. PCT/EP2016/082882, dated Feb. 21, 2017, 10 pages.
Non Final Office Action for U.S. Appl. No. 16/473,720, dated Mar. 30, 2021, 23 pages.

* cited by examiner

80''
331
112
124

80''
41
331'

331
338
124
112
80'
338
118
330
32

331
337

LAUNDRY DRYER COMPRISING A FILTER ASSEMBLY AND A METHOD TO CLEAN A FILTER ASSEMBLY

This appiication is a U.S. National Phase application of PCT International Application No. PCT/EP2016/082888, filed Dec. 29, 2016, which is incorporated by reference herein.

BACKGROUND

The present invention relates to a laundry dryer comprising a filter assembly having a cleaning device and to a method to clean such a filter assembly by means of the cleaning device.

Laundry dryers usually comprise filter systems for collecting fluff or lint which is detached from the laundry to be treated in the drying process. Typically, a prior art tumble dryer provides a filter system which is accessible for control and/or maintenance by opening a door of the tumble dryer. An air flow is provided inside the tumble dryer that enters the filter system. Fluff or lint (in general foreign substances) that is carried by the air flow from the laundry to be dried is filtered out by the filter system, such that air that leaves the filter system is substantially free from lint or fluff. Said air can be heated up again and conveyed to the laundry treatment chamber of the tumble dryer. Alternatively, air can be vented outside the dryer.

If the accumulation of the foreign substance on the filter system becomes greater than a pre-set level, the foreign substance can interfere with the discharge of the air from the drum by reducing the circulation of air from to the drum; thus, the filter system in the dryer should be cleaned periodically.

The way in which the operation of cleaning of the filter is performed depends on the type of filter system used. For example, some dryer includes below the laundry loading/unloading door a plinth having a plinth door to be opened in order to reach the filter system and clean the same using a suitable tool, leaving the filter system in place. Alternatively, the filter system cleaning is carried out as the user separates the filter system from the dryer after finishing a drying cycle, removes the foreign substance from the filter system, and again mounts the filter system into the dryer. Further cleaning operations of known type provide for removing foreign substances through a fluid sprayed onto the fluffed filter system. The activation of the fluid spraying operation is generally automatic, i.e. activated by the laundry drying control unit algorithm. Such automatic filter cleaning operation requires the provision of complex arrangements in the dryer architecture which, however, always need a user to remove the washed-off fluff from the machine.

Filter cleaning carried out manually with an external tool or by removing completely the filter system is not only cumbersome but also generally not liked by the user, and the cleaning operation may sometimes be over-looked. Due to this, because the filter cleaning may not be carried out every time the dryer is operated, until the filter is cleaned, a failure to secure adequate air flow rate required for drying due to the foreign substance interfering with the air flow being discharged from the drum can be obtained, thereby reducing the overall efficiency of the drying machine and even causing the laundry not to be as dried as the user desires at the end of a drying cycle.

Further, in case the cleaning of the filter system requires an external tool, such as a brush, the latter can be lost or misplaced. In case the filter system needs to be removed from the laundry dryer in order to be cleaned, this may cause damages to the filter system itself in case of improper handling.

SUMMARY OF THE INVENTION

The goal of the present invention is therefore to render available a laundry dryer including a filter assembly and a method to clean a filter assembly in a laundry dryer in which the cleaning operations of the filter assembly are simplified with respect to the prior art of record.

Preferably, the cleaning of the filter assembly does not require additional tool(s) external to the dryer which needs to be stored away and retrieved at the time of cleaning.

Further, the act of cleaning is preferably relatively easy and quick.

According to a first aspect, the invention relates to a laundry dryer comprising:

- a cabinet;
- a drum rotatably supported in the cabinet;
- a duct defining a flow passage for process air exiting the drum;
- a filter assembly positioned at least partially in the duct so as to filter process air flowing therein;
- said filter assembly including:
  - a frame;
  - a filter supported by the frame and defining a first filtering surface;
  - a cleaning device for cleaning the first filtering surface;
- wherein said cleaning device includes
  - a wiper portion to wipe the first filtering surface, said wiper portion being positioned in a wiper seat, and
  - a manually operable handle portion connected to the wiper portion,
  - said cleaning device being pivotably attached to the frame so as to rotate around an axis, to be movable from a first resting position wherein the manually operable handle portion is substantially completely housed in said wiper seat to a plurality of wiping positions in which the wiper portion wipes the first filtering surface and wherein, at least in one of said wiping positions, said manually operable handle portion protrudes from said wiper seat, and
  - wherein said manually operable handle portion is operable to perform the transition from the first resting position to any of the wiping positions.

According to a second aspect, the invention relates to a method to clean a filter assembly of a laundry dryer, said laundry dryer comprising:

- a cabinet;
- a drum rotatably supported in the cabinet;
- a duct defining a flow passage for process air exiting the drum;
- a filter assembly positioned at least partially in the duct so as to filter process air flowing therein;
- said filter assembly including:
  - a frame;
  - a filter supported by the frame and defining a first filtering surface;
  - a cleaning device for cleaning the first filtering surface;
- wherein said cleaning device includes
  - a wiper portion to wipe the first filtering surface, said wiper portion being positioned in a wiper seat, and
  - a manually operable handle portion connected to the wiper portion, said cleaning device being pivotably attached to the frame so as to rotate around an axis;
  - said method comprising:

bringing said manually operable handle portion from a first resting position wherein the manually operable handle portion is substantially completely housed in said wiper seat to a wiping position in which said manually operable handle portion protrudes from said wiper seat;

wiping said first filtering surface acting on said manually operable handle portion, while said manually operable handle portion remains in said wiping position.

In the following, when relative terms such as "front", "back", "rear", "lateral", "top", "bottom", etc. are used, they refer to the normal operational position of the laundry dryer when in use, e.g. located on a floor which usually is (substantially) horizontal. Thus, a horizontal plane is a plane parallel to the floor where the dryer is located. The location of a loading/unloading door of the laundry dryer, usually used to load and unload laundry from the dryer and generally coupled to a front wall of the cabinet in order to access the drum, defines the "front" of the dryer itself. Given the horizontal plane on which the laundry is located, "top" and "bottom"—as their normal common meaning—refer to the position of an object along a vertical axis. The vertical axis is defined as an axis perpendicular to the horizontal plane, such as the floor.

With the terms "laundry dryer" or "dryer" both an appliance having drying functions only, or a combined washer-dryer appliance, which is capable of performing both washing and drying cycles, are meant.

The dryer includes a cabinet or bearing structure, comprising preferably a basement, a front wall and a rear wall. The front and rear wall are preferably mounted on the basement, which is standing on a surface, such as the floor. The front wall may advantageously be provided with a through opening, at which a door is mounted to access the interior of the cabinet in order to locate or remove the laundry. Lateral walls connect the front and the rear wall to form, together with a top wall, a closed volume.

The basement rests on a floor and its vertical distance from the floor may be advantageously adjusted through regulating feet provided on the lower surface of the basement facing the floor.

The basement defines in turn a plinth region of the dryer. The plinth has a plinth inner volume, that is, the volume inside the cabinet delimited by the cabinet walls and located at the plinth region. The plinth may be perforated, or including a perforated element, so as to enable cooling air to be taken in and expelled, if needed. The plinth can be provided with portions for supporting operational components of the laundry dryer that are needed for carrying on a laundry drying process on laundry, such as air conduits, motors and so on.

The laundry dryer of the invention includes a drum, in which the load, e.g. clothes or other laundry, to be dried is placed. The drum further preferably includes a mantle defining a front end and a rear end, the front end facing the front wall of the cabinet, and preferably the opening therein realized and closed by the door for loading and unloading the laundry, and a rear end facing the rear wall of the cabinet.

The drum of the dryer of the invention may be closed drum, i.e. the rear end is closed by a back wall or a flange, which rotates as a single piece together with the mantle when the drum is driven into rotation. Alternatively, it can be an open drum, where the closure of the rear end of the drum is given by a back wall which is stationary, that is, it does not rotate with the drum and it is preferably integral to the cabinet. Thus, the back wall of the drum can be either attached to the drum and rotate with the same, or attached to the cabinet and be still.

Within the cabinet, the drum is rotatably mounted for rotating, preferably according to a substantially horizontal or tilted rotation axis. For example, at least one drum support assembly for rotatably supporting the drum in its rotation around this given rotation axis is provided for within the cabinet.

The drum is fluidly connected to a duct defining a flow passage for process air exiting the drum. Indeed, relatively dry and warm process air flows on the laundry located in the drum so as to dry the same. The then humid cooler process air needs to be removed from the drum so that, for example, additional dry air can flow in.

The drum is part of a process air circuit, in particular a closed-loop circuit in case of a condensed dryer or an open circuit in case of a vented dryer, which in both cases includes a process air duct for channelling a stream of process air to dry the load. The process air duct may be connected with its two opposite ends to the drum. In this embodiment, hot dry air is fed into the drum, flowing over the laundry, and the resulting humid (and to a lower temperature cooled down) air exits the same. In case of a closed-loop drying air circuit, the humid air stream, rich in water vapour, is then fed into a humidity removal element and/or a hot air generator, such as a heat exchanger. The resulting cool dry air is then heated up before re-entering again in the drying chamber by means of a hot drying air generator, which can be for example a condenser of the heat pump system or an air/air exchanger, and the whole loop is repeated till the end of the drying cycle. Furthermore, the hot drying air generator may comprise an electrical or gas powered heating device. In a vented dryer, ambient air is taken into the dryer via an inlet duct, such air is heated up by a hot drying air generator, such as condenser of a heat pump system and/or an electrical or gas powered heating device, before entering the drum. Heated air flowing through and on humid laundry contained in the drum, removes humidity from laundry. Humid air stream exiting the drum may be optionally dehumidified by an evaporator of a heat pump system, or an air-air type heat exchanger as explained above, before being exhausted outside the dryer.

Preferably, the hot or drying air generator is located in a basement of the cabinet.

In an embodiment, the duct is guiding the process air from the drum. A section of the duct, preferably a front duct section, guides the process air coming out of the drum downwards towards the basement of the laundry dryer and deflects the process air flow from the downward direction to a horizontal direction. 'Downward' direction may include flow path sections that are vertical and/or (partially) inclined to the vertical or even partially horizontal—however with the net effect that in the channel section unit the process air is guided downward from a higher to a lower altitude level (in the normal operation orientation of the laundry treatment apparatus). Preferably the process air deflected to the horizontal flow direction is either vented to the outside or enters into the hot or drying air generator. In this latter case, then the process air then re-enters the drum, via for example a rear wall of the same, which can be perforated.

Further, preferably, the process air duct may include a fan to blow the process air flowing into the process air duct.

The process air duct is also provided with a filtering assembly, which is arranged along the duct, before the vent in case of a vented dryer, so that fluff is not disposed to the outside, or upstream the hot or drying generator, in case of a condensed dryer, to prevent the fluff and/or lint particles from reaching and clogging up the generator and/or the fan.

Any filter assembly can be used in the present invention, as long as it includes a first filtering surface supported by a frame.

In the same way, the first filtering surface may have any shape, it may for example include a mesh or net having a proper size to block the typical fluff or particles generated by the laundry. As an example, the filter assembly may include a flat first filtering surface having a square shape. The filtering surface may be substantially vertical. Alternatively, the filtering surface may be tilted with respect to a vertical plane, or more than a filtering surface may be present. Further, the frame defines an inner frame volume. For example, the frame may have a box-like shape the walls of which surround an inner volume. The walls may be open or closed.

Alternatively, the filter assembly may include a substantially wedge-shaped filtering cartridge, which can be for example fitted in removable manner into an air-filtering cartridge seat realized on the annular frame that delimits the laundry loading/unloading opening on the front wall of the cabinet so as to cover/close the whole seat. In this case, the filtering surface may be tilted with respect to a vertical plane due to the wedge-shape of the cartridge.

Further, the filtering assembly includes a cleaning device apt to clean the first filtering surface, where, as mentioned, fluff, particles, dust and other material may be present, filtered from the process air leaving the drum and entering the duct. This material is filtered by the filtering surface of the filtering assembly, which is preferably properly dimensioned and positioned into the duct so that substantially the whole dimension in cross section of the duct is covered by the filtering surface. In this way, most of the foreign material present in the process air is removed by the filtering surface.

Due to the filtering action, the filtering surface becomes with time covered by the filtered material which has been removed from the process air flowing in the duct. In order to maintain efficiency of the dryer, the collected material on the filtering surface needs to be periodically removed.

The means to remove such material from the first filtering surface includes in the present invention the cleaning device, which is, in the dryer of the invention, manually operated so that it can also be operated when the dryer is switched off and does not require any complex electrical circuit which has to be safely sealed to avoid humidity.

The cleaning device of the invention comprises a wiper portion to wipe the first filtering surface, and a manually operable handle portion connected to the wiper portion. When the manually operable handle portion is actuated, for example handled by a user, movements of the manually operable handle portions result in movements of the wiper portion, in particular to wipe the first filtering surface. The wiping takes place due to the contact between the wiping portion and the first filtering surface. Such contact can be a friction contact, that is, preferably scratching, scraping or brushing of the first filtering surface takes place during the wiping movement. Thus manual movements of a user gripping the manually operable handle portion result in wiping of the first filtering surface due to a consequent movement of the wiper portion.

The wiper portion is housed in a wiper seat, for example defined by the frame of the filter assembly or by the cabinet.

To achieve this wiping movement, the cleaning device is pivotably attached to the frame, so that it can rotate around an axis. Preferably, this axis is substantially parallel or angled with an angle of at least 80° to the first filtering surface. The rotation of the cleaning device, and thus preferably of the wiper portion is taking place from a resting position where the manually operable handle is substantially housed in the wiper seat, that is, it does not protrude from the latter so that it is not in the way and does not hinder any standard operation of the dryer, to a wiping position, and preferably to a plurality of wiping positions, in which the wiper portion is wiping the first filtering surface removing the foreign material deposited therein. Further, in at least one of the wiping positions, the manually operable handle portion protrudes from the wiper seat, so that it can be easily handled and operated by the user.

The transition between the resting position to the wiping position(s) is preferably performed by the user and his/her action on the manually operable handle portion, that is, on his/her handling of the manually operable handle portion. The manually operable handle portion is moved from one position to the other so that it is first "hidden" in the wiper seat (hidden when there is no need of wiping) and then it protrudes from the latter (when wiping is needed).

In this way an easy wiping is performed, due to the fact that—when not used—the cleaning device is substantially "hidden" and the standard usage of the dryer does not change or require special adaptation. The wiping itself is very simple because in the wiping position the cleaning device is very easily handled by the user via the manually operable handle portion.

Further, all elements forming the filter assembly are located within the filter assembly itself, so there is no need of separated cleaning device which can be misplaced or lost.

According to any of the above mentioned aspects, the invention may include in combination or as alternative any of the following characteristics.

Preferably, said manually operable handle portion is movable in relation to the wiper portion from a retracted configuration allowing the cleaning device to be placed in said first resting position to an extended configuration allowing the cleaning device to be manually moved in at least one of said wiping positions.

As mentioned, the manually operable handle portion is in the resting position substantially "hidden" in the wiper seat, and then in the wiping position it protrudes from the wiper seat to be easily handled by the user. The manually operable handle portion—in an embodiment—in order to transition from the resting to the wiping position, may be moved from a retracted to an extended position, so that in the first one it can be housed in the wiper seat, while in the latter in may protrude from the wiper seat. The manually operable handle portion can be for example of the telescopic type.

Preferably, said manually operable handle portion is movable from an angled configuration wherein it forms an angle different from 180° with said wiper portion thereby allowing the cleaning device to be placed in said first resting position, to a parallel configuration allowing the cleaning device to be manually moved in at least one of said wiping positions, where the manually operable handle portion extends along an axis of said wiper portion.

In a different embodiment, in order to move from the resting to the wiping position, that is, from a position where the manually operated handle portion is within the wiper seat to a position where it extends from the same, the manually operated handle may be angled differently in the two positions. In the resting position, the manually operable handle portion and the wiper portion are aligned along two axes which are incident. For example, they can form a rather small angle so that the handle portion can be folded and positioned within the wiper seat. In the wiping position, handle and wiper portion can be brought to an extended configuration, were handle portion and wiper portion are substantially parallel to each other and the manually operable handle portion protrudes from the wiper seat.

Preferably, said manually operable handle portion is movable from a folded configuration allowing the cleaning device to be placed in said first resting position to an unfolded configuration allowing the cleaning device to be manually moved in at least one of said wiping positions.

In a further different embodiment, the wiper and handle portions change their mutual configuration in order to transition from the resting to the wiping position.

Advantageously, said manually operable handle portion is integral to said wiper portion.

In the following, with the terms "realized integral to" mean that the element discussed is realized as a single unit together with another element, without discontinuities. A first element realized integral to a second element thus means that the two are a single piece, a unitary body. Thus, in this embodiment, the wiper and handle portions are one fixed to the other and their mutual position does not change. They rotate as a unit around the axis to which the cleaning device is pivoted.

In an embodiment, said filter assembly includes the first and a second filtering surface, and wherein said wiper portion is positioned between said first and second filtering surfaces. More preferably, said wiper portion includes a first wiping element in contact with said first filtering surface when the cleaning device is in any of the wiping positions and a second wiping element in contact with said second filtering surface when the cleaning device is in any of the wiping positions.

In an embodiment, the filter assembly includes two filtering surfaces, for example positioned one in front of the other to define the wiper seat. The wiper portion is thus preferably positioned within the wiper seat, that is, between the two filtering surfaces. The wiping portion may therefore include a first and a second wiping element in order to wipe both surfaces during the wiping movements.

Even more preferably, said wiper portion includes a connector to connect the first and the second wiping elements, said connector being air-permeable in a given direction.

In case the two wiping portions perform the same movement while moved by the manually operable handle portion on the first and the second surface, in order to strengthen their connection, a connector is positioned between the first and the second wiping elements. The connector keeps the two wiping elements firmly fixed one to the other. In order not to disturb the flow of process air, preferably the connector is air permeable, so that the flow of process air flowing through the duct can pass the connector without being blocked by it.

Even more preferably, each of said first and second wiping elements defines a first and a second end, respectively, and wherein said connector includes any of:

- a wall with perforations connecting the first and second wiping elements;
- a plurality of ribs connecting said first and said second elements;
- a first and a second crosspiece connecting said first and second wiping elements at their respective first and second ends.

In order to realize a connector which is air permeable, several possibilities arise. For example, the connector may include perforations, or it may include ribs or crosspieces connecting the two wiping elements.

Preferably, the connector is air permeable in the direction perpendicular to the direction of the main flow of the process air. For example, the connector may be air permeable in a direction substantially perpendicular to a plane including the first filtering surface. The connector may be air permeable in a direction perpendicular to a plane defining the inlet of the wiper seat.

Preferably, said wiper portion defines a longitudinal axis, said longitudinal axis in said first resting position being substantially horizontal.

In the resting position, the wiper portion is preferably horizontal, that is, preferably parallel to a surface where the laundry dryer is located.

Preferably, said connector in said first resting position extends along a substantially horizontal plane.

Wiper portion and connector may both lie on a plane parallel to the surface where the dryer is located.

Preferably, said connector in said first resting position includes a surface which is substantially perpendicular to the process air flow. More preferably, said surface is air permeable.

As above mentioned, in order to avoid disturbance of the process air flow, the connector, which faces the air flow, is preferably air permeable. In order to do so, preferably a surface of the connector is air permeable, more preferably the air permeable surface is positioned substantially perpendicular to the air process main flow. Being the air process flow in the filter assembly preferably a downwards flow, i.e. a vertical flow at the inlet where the filter assembly is located, from an upper to a lower position along the duct, preferably this air permeable surface is horizontal.

In any of the embodiment, preferably, the air flow impinges on the connector from the above through the air permeable surface of the latter, and then the air flow rotates of substantially 90° within the filter assembly so that it exits the filter assembly through the first filtering surface.

Advantageously, said frame includes an upper portion, where the cleaning device is pivoted.

Preferably, the filtering surface is positioned substantially vertically, or with a small tilt with respect to the vertical direction. The upper portion of the frame is thus the portion of the frame having the top most vertical position. In this upper portion, the cleaning device is pivoted.

More preferably, said cleaning device is pivoted in a point symmetrically dividing the upper portion in two.

In this way, the movements of the wiper portion can also be symmetrical.

Preferably, said frame includes a lower portion, said lower portion having a curved shape. More preferably, said curved shape includes a portion of a mantle of a cylinder. Even more preferably, said wiper portion includes a first and a second end, and wherein, in any of said wiping positions, said wiper portion is in contact with one of its first or second end to said lower portion.

Preferably, the wiper portion is capable of wiping the first filtering surface in its entirety. In order to perform this wiping of the whole first filtering surface, given that the movement of the wiping portion is a rotational one and the wiping portion is preferably a rigid body, the end of the wiping portion draws an arch of a circumference. The surface which can thus be spanned by the wiper portion has therefore the shape of a circular sector. The angle of the circular sector depends on the amount of rotation of the cleaning device around its axis. For example, for a wiping angle, that is, for a rotation angle, of 180°, a wiping surface having the shape of half a disk is spanned. Therefore, in order to be completely wiped, also the first filtering surface preferably has a corresponding shape of that one which can be wiped by the wiper portion. Thus, preferably also the first filtering surface has or includes a circular sector shape, having thus a curved end. The curved end does not need to match precisely the shape of an arch of circumference because the frame, having a finite thickness and framing the filtering surface, does not need to be wiped.

Preferably, said cleaning device is pivotably attached to the frame at a pivot point and said pivot point geometrically separates the handle portion from the wiper portion of the cleaning device.

The cleaning device it is thus divided in its two portions, the wiping and handle portions, by means of the pivot.

Advantageously, said cabinet includes said wiper seat to house said filter assembly, said wiper seat being positioned downstream said drum in the flowing direction of the process air.

As seen above, a possible wiper seat can be defined by the filter assembly itself having two filtering surfaces forming a gap therebetween. Alternatively or in addition, the cabinet itself may form a wiper seat.

Preferably, said filter assembly is removably housed in said wiper seat.

In this way, the filter assembly can be easily repaired if needed, or fluff or material stuck in it can be easily removed.

More preferably, said cabinet includes a loading/unloading aperture to allow access to the drum and a door to close said aperture, an inlet of said wiper seat being formed on a surface area delimiting said aperture.

The filter assembly location may be a standard location of the filter according to the prior art, co that it can be reached opening the loading/unloading door of the dryer used to load or unload the laundry itself.

Preferably, said filter assembly has a shell-like structure and said first and second filtering surfaces are one facing the other. More preferably, said shell-like structure is openable. Even more preferably, said filter assembly defines said wiper seat between said first and said second filtering surfaces.

The filter assembly can therefore be shaped for some parts as a "standard" filter to which the cleaning device is added. In this way, not all components of the filter assembly have to be especially made for the laundry dryer of the invention, but some can be used also in other dryers.

Preferably, said filter assembly comprises the first filtering surface and a non-filtering surface facing the first filtering surface, said wiper seat being defined between said first filtering surface and said non-filtering surface.

In this configuration, the filter assembly is defining a seat for the wiper between the first filtering surface and the non-filtering surface, but one surface only, the filtering one, is subjected to the flow of process air in order to filter it.

Preferably, said cabinet includes a further door, such as a rotatable door, and said filter assembly is attached to said further door. More preferably, said non-filtering surface is attached to said further door.

The filter assembly can be attached to a door, used for example to access a portion of the dryer different from the drum (which is accessible opening the loading/unloading door). By opening this further door, the filter assembly can be for example removed, or the cleaning device actuated in order to wipe the filtering surface, by means of the manually operable handle portion.

More preferably, said cabinet includes a loading/unloading aperture to allow access to the drum and a door to close said aperture, said further door being located below said loading/unloading aperture. More preferably, said further door is a plinth door giving access to a plinth portion of the cabinet or a door accessible by opening said plinth door.

The plinth of the dryer advantageously comprises an openable plinth door, typically hinged at one side to the remaining of the cabinet, for enabling the access to the inner region of the cabinet and, in particular, to the heat exchanger, if present, or in order to empty the condense water collection tank, for cleaning the condensing system or generally for maintenance purposes.

More preferably, said further door is a rotatable door hinged to a front wall of said cabinet defining a rotatable axis, said rotatable axis being substantially horizontal.

Preferably, said filter assembly defines a portion of said duct for said process air. More preferably, said non-filtering surface is a portion of a delimiting wall of said duct.

When the filter assembly is located in the plinth region, it can be part of the duct itself. For example, the non-filtering surface may be a wall, or part of a wall, of the duct. The filter assembly is then used to guide and eventually bend the flow of process air.

Advantageously, said cleaning device is rotatable around an axis, to be movable from the first resting position to a second resting position. More preferably, said first and second resting positions are angularly separated by an angle of at least 100°. Even more preferably, said wiping positions are angularly positioned between said first and second resting positions.

The wiping preferably takes place rotating the wiping portion. The wiping portion thus rotates around the pivot defined in the frame and moves around an axis, changing an angle formed with a fixed line defined by the first resting position. After the wiping, the wiping portion ends into a second resting position, which may coincide with the first resting position or might be different from it, for example angled by 180° from the first resting position.

Preferably, said filter assembly includes a first and a second shell-like structure both having filtering surfaces, said second shell-like structure being inserted within the first shell-like structure. More preferably, said cleaning device is apt to wipe a filtering surface located in said first and/or second shell-like structure.

The filter assembly of the invention may have different shapes, may include for example a double shell structure in case of an enhanced filtering is desired.

In a preferred embodiment, the laundry dryer includes:

- a plinth as base portion of said cabinet, said plinth defining an inner plinth volume within said cabinet and said filter assembly being located in said inner plinth volume;
- an actuator, adapted to force said cleaning device to perform said rotational movement with respect to said frame when actuated, said actuator including said manually operable handle portion and being located remote from said filter assembly; and
- a connecting element, to connect the actuator and the wiper portion, so that movements of the actuator are transformed in rotational movement of the wiper portion.

The wiper portion may be actuated remotely, that is, the position of the manually operable handle portion and the position of the wiper portion may be remote one from the other. For example, the filter assembly can be located in the plinth portion and an actuator—including the manually operable handle portion—can be located in another region of the dryer. A connecting element connects the actuator and the wiper portion so that movements of the actuator forces movement of the wiper portion.

Preferably, said actuator is adapted to perform a rotation around an axis. More preferably, said axis is parallel to an axis of rotation of said cleaning device during wiping.

In order to obtain rotations of the wiper portion around an axis, the actuator—in an embodiment—also perform rotations around an axis parallel to the one around which the wiper portion rotates. For example, the connecting element may Include a gear connected to the wiper portion and a meshing gear connected to the actuator, so that rotations of the actuator, due to the meshing gears, result in rotations of the wiper portion.

Advantageously, said cabinet includes a loading/unloading aperture to allow access to the drum and a door to close said aperture, an inlet of said duct being formed on a rim of said aperture, and wherein said actuator is located in said inlet.

For example, the actuator may be located at the loading/unloading door so that, in order to operate it, the door has to be opened. The actuator cannot be operated by accident, because during the normal functioning of the dryer, or when the drier is switched off, is hidden and protected by the loading/unloading door.

Preferably, said connecting element is realized in plastic and/or metal.

Preferably, the connecting element includes a rack.

A rack includes a plurality of teeth on a planar surface so that, for example, a linear movement can be transformed into a rotation or vice-versa. Movements of the actuator can be thus transformed in a different type of movements of the wiper portion. This allows not to be limited in the type of movements available for actuator and wiper.

Advantageously, the actuator includes the manually operable handle portion having an end pivoted around an axis, said end forming a portion of a gear wheel. More preferably, said gearwheel portion is meshed with a further gearwheel portion connected to said wiper portion.

In this way a rotation of the actuator, that is, a rotation of the manually operable handle around an axis, for example performed by the user gripping the handle as a leverage, turns into a rotation of the wiper portion around a parallel axis, due to the gears meshing.

Preferably, the method includes:

rotating the cleaning device operating the manually operable handle portion by 180° so as to wipe the whole first filtering surface.

More preferably, the method includes:

rotating the cleaning device operating the handle portion by an angle bigger than 180° so as to wipe the whole first filtering surface, operating the manually operable handle portion for the whole rotation.

It is preferred to wipe the whole first filtering surface. Therefore a rotation of the wiper portion of at least 180° is foreseen.

Advantageously, said cabinet includes a loading/unloading aperture to allow access to the drum and a door to close said aperture and wherein the method includes:

Opening said door in order to access said filter assembly before wiping said first filtering surface.

In order to grab the manually operable handle portion, preferably the loading/unloading door is opened. The handle portion is therein positioned, in a way that preferably does not hinder the normal loading/unloading of the laundry when wiping of the filtering surface is not performed. For example, a seat may be foreseen in a surface delimiting the loading/unloading aperture.

Preferably, said cabinet includes a further door and said filter assembly is attached to said further door and wherein said method includes:

Opening said further door in order to access said filter assembly before wiping said first filtering surface.

In addition to the loading/unloading surface, the dryer preferably includes a further door, such as a rotatable door, which for example gives access to a further portion of the dryer inside the cabinet (in addition to the drum). In this further portion of the cabinet, the filter assembly is positioned. This further position could be for example the plinth of the dryer, that is, the plinth inner volume defined within the cabinet at the plinth of the dryer.

Preferably, the method includes:

removing filtered material from the wiper portion after the rotation.

In the wiping motion, the wiping portion is scratching/scraping/brushing against the first filtering surface. The scratching/scraping/brushing can be performed by the filtering element in contact to the first filtering surface. This fluff and filtered material scratched during the wiping action, is collected in front of the wiper portion by the wiper portion motion. The filtered material is then eventually pushed outside the frame when the wiper portion has reached the end of the wiping movement, for example when it reaches the resting position. This collected fluff and filtered material is then preferably removed, for example by the user using his/her hands.

Advantageously, the method comprises:

bringing said manually operable handle portion back to said first resting position after said wiping.

Alternatively, said manually operable handle portion is movable from the first resting position to a second resting position, the method comprising:

bringing said manually operable handle portion from the first resting position to the wiping position;

wiping said first filtering surface while said manually operable handle portion remains in said wiping position; and reaching said second resting position of the manually operable handle at the end of said wiping.

The wiper portion at the end of the wiping movement, when the first filtering surface has been cleaned, can either return back to its original position, that is, to the first resting position, or it may reach a different end position, called the second resting position, from which a subsequent wiping action will start.

Advantageously, the method comprises:

By means of the cleaning device, bringing foreign substances wiped from said first filtering surface at least partially out of said wiper seat so as to be reached by a user hand.

The wiper portion rotation is preferably so realized that, at the end of it, that is, at the end of the wiping movement when the wiper portion has gone through all the wiping positions, the wiper portion is at the upper edge of the frame, or even outside it. The wiper portion thus may protrude, even slightly, from the wiper seat. The fluff and filtered material removed from the first filtering surface can thus be easily collected by the user.

BRIEF DESCRIPTION OF THE DRAWINGS

Further advantages of the present invention will be better understood with non-limiting reference to the appended drawings, where.

DETAILED DESCRIPTION OF EXEMPLARY EMBODIMENTS

Figure 1:
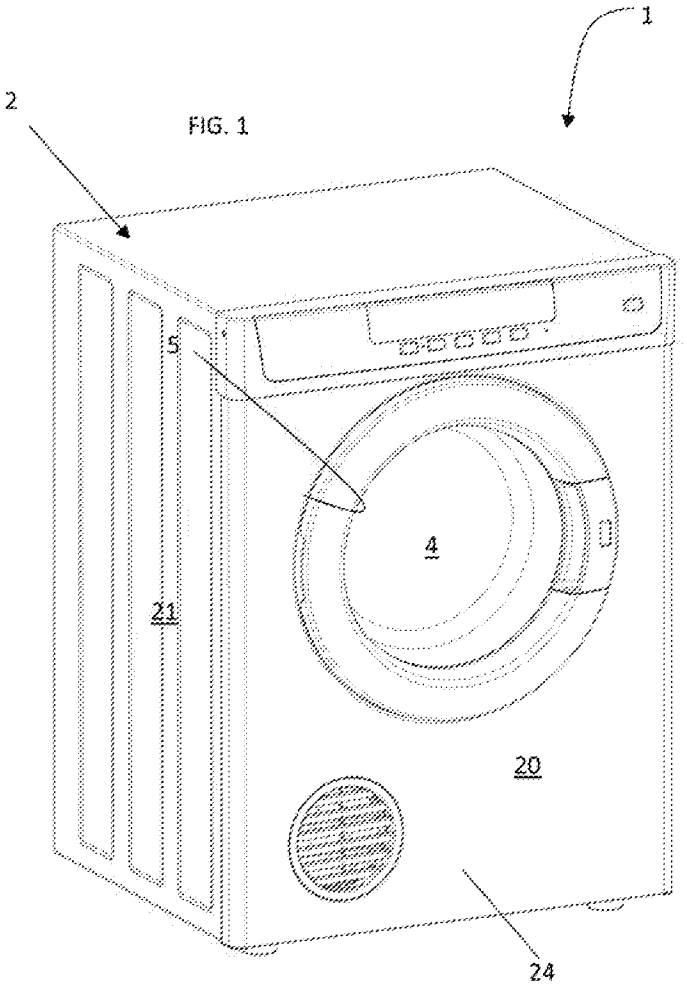
FIG. 1 is a perspective view of a laundry dryer realized according to the present invention.

With initial reference to FIG. 1, a laundry dryer realized according to the present invention is globally indicated with 1.

Laundry dryer 1 comprises an outer box cabinet 2, preferably but not necessarily parallelepiped-shaped, and a drying chamber, such as a drum 3 (visible only in FIGS. 3-4), for example having the shape of a hollow cylinder, for housing the laundry and in general the clothes and garments to be dried. The drum 3 is preferably rotatably fixed to the cabinet 2. Access to the drum 3 is achieved for example via a door 4, further referred also as the loading/unloading door, preferably hinged to cabinet 2, which can open and close a loading/unloading aperture 5 realized on the cabinet itself.

More in detail, cabinet 2 generally includes a front wall 20, a rear wall 21 and two sidewalls 25, all mounted on a basement 24. Preferably, the basement 24 is realized in plastic material. Preferably, basement 24 is molded via an injection molding process. Preferably, on the front wall 20, the door 4 is hinged so as to access the drum. The cabinet, with its walls, defines the volume of the laundry dryer 1. The basement 24 rests on a floor and its vertical distance from the floor may be advantageously adjusted through regulating feet (not shown) provided on the lower surface of the basement facing the floor. The dryer 1, and in particular basement 24, defines an horizontal plane (X,Y) which is substantially the plane of the ground on which the dryer 1 is situated, thus it is considered to be substantially horizontal, and a vertical direction Z perpendicular to the plane (X,Y).

Laundry dryer 1 also preferably comprises an electrical motor assembly (not shown) for rotating, on command, revolving drum 3 along its axis inside cabinet 2.

Figure 15:
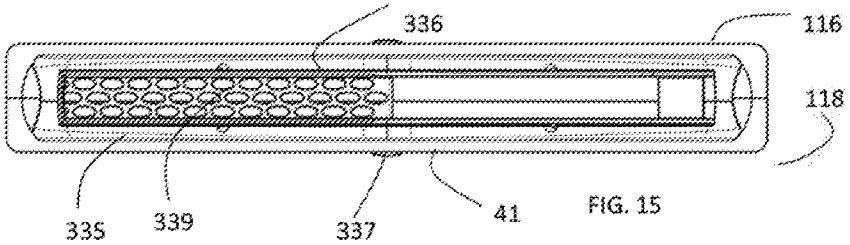
FIG. 15 is a top view of the second embodiment of the filter of FIG. 11-14.
Figure 16:
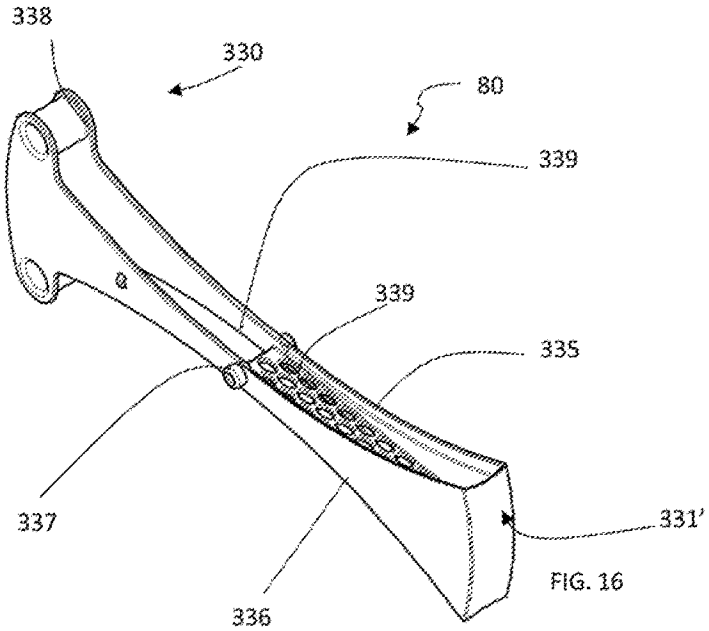
FIG. 16 is a perspective view of an element of the second embodiment of filter assembly of FIGS. 11-14.

In the drum 3 of the laundry dryer 1, the load, e.g. clothes or other laundry, to be dried is placed via the door 4 provided on the front wall 20 of the cabinet. The drum preferably includes a mantle defining a front end 3*a* which is facing the front wall 20 of the casing and a rear end 3*b* facing the rear wall 21 of the casing (visible only in FIG. 15).

Figure 2:
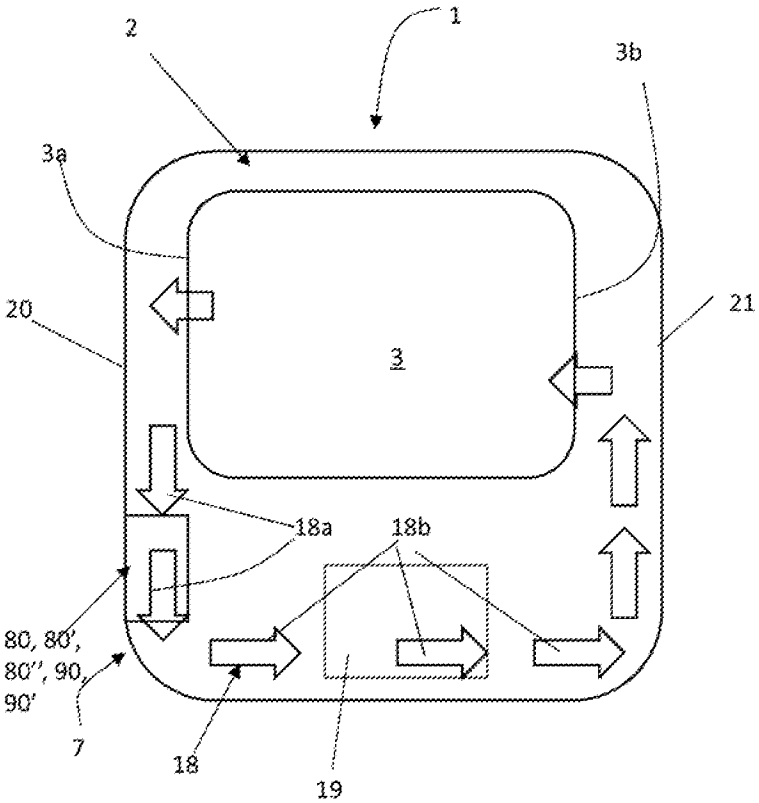
FIG. 2 is a schematic view of an air process duct in the dryer of the invention.

With now reference to the schematic view of FIG. 2, the drum 3 is fluidly connected to a duct defining a process air circuit 18 (depicted with a series of arrows in FIG. 2). The process air circuit 18 involves the circulation—first—of relatively dry and warm process air, inside the drum 3, on the laundry located therein so as do dry it and—second—of humid cooler process air, outside the drum 3. New dry and warm process air enters the drum 3 and the circuit is repeated until desired, preferably until the laundry is dried. When the humid process air exits the drum 3, it may be channeled in different ways, depending on the dryer type.

If the dryer 1 is a condensed dryer, the circuit 18 of the process air is a closed-loop circuit and the humid process air leaving the drum 3 is first dried by passing through a humidity removal element and/or a hot air generator, such as a heat exchanger 19. The resulting cool dry air is then heated up by means of the hot air generator 19 before re-entering again the drum 3. Preferably, the hot air generator is a heat pump and the humid air is first passing through an evaporator where the water contained in it is removed and then it is heated in a condenser before returning into the drum 3.

If the dryer 1 is a vented dryer, the circuit of the process air is open, i.e. ambient air is taken into the drier, heated up and entered into the drum 3 while the humid process air leaving the drum 3 is exhausted outside the dryer 1. This open circuit is not depicted in the drawings.

Preferably, the hot or drying air generator (e.g. heat pump 19) is located in a basement 24 of the cabinet.

The duct forming the process air circuit 18 includes a first portion 18*a* having an inlet 16 connected with the front end 3*a* of the drum. This first portion 18*a* receives the air coming from the drum 3. The inlet 16 of the first portion 18*a* of the duct is located preferably at a surface 17 contouring a rim of loading/unloading aperture 5, as visible in FIG. 3. Further, preferably, this first portion 18*a* of the duct is substantially vertical, that is, the process air flowing within the first portion 18*a* has the longest component of motion along a vertical axis. The process air coming from the drum 3 thus, flowing substantially horizontally, or having a motion with a longest horizontal component, needs to turn by substantially 90° at the loading/unloading aperture 5 so that it can flow within the first portion 18*a* of the duct via inlet 16. This situation is schematically depicted in FIG. 2.

Further, the first portion 18*a* of the duct extends from the inlet 16 into the basement 24. The duct then preferably continues with a second portion 18*b* which extends in the basement 24 and runs substantially horizontally, or with a longer horizontal component, so that the process air, at the end of the first portion 18*a*, performs a further 90° bend to continue its flow.

The process air then either preferably passes through the rear end 3*b* into the interior side of the drum 3, so the circuit 18 is a closed loop circuit as depicted. There, the air absorbs moisture or humidity from the laundry and, thus, dries the laundry. Alternatively, the process air is directed outside the dryer 1 via a vent (not visible in the attached drawings).

The dryer 1 is adapted to provide circulation of air, preferably with variable temperature. The process air flow is preferably generated in a region below the basement, e.g. In the duct of the process air circuit 18, for example by means of a fan (not depicted in the drawings).

The duct defining the process air circuit 18 is also provided with a filter assembly, preferably situated in proximity of or at the front wall 20 of the cabinet 2, with the purpose of stopping the fluff and/or lint particles detached from the laundry during the drying process to reach undesired locations and flowing with the process air. For example, in a vented dryer, the filter assembly is situated upstream the vent such that the fluff and/or lint is stopped from reaching outside the dryer together with the humid process air leaving the drum 3 and being exhausted outside. In a condensed dryer, the filter assembly is situated upstream the hot or drying generator 19 for stopping the fluff and/or lint from reaching and clogging up said generator.

The duct 18 thus guides the process air leaving the drum 3 towards the filter assembly. The filter assembly is preferably arranged in such a way that the process air passes there through, reaches the end of the first portion 18*a* of the duct and flows within the second portion 18*b*, and advantageously reaches the region below the basement, where it is again sucked in by the fan.

Preferably, the filter assembly is arranged below the drum 3.

Figure 4:
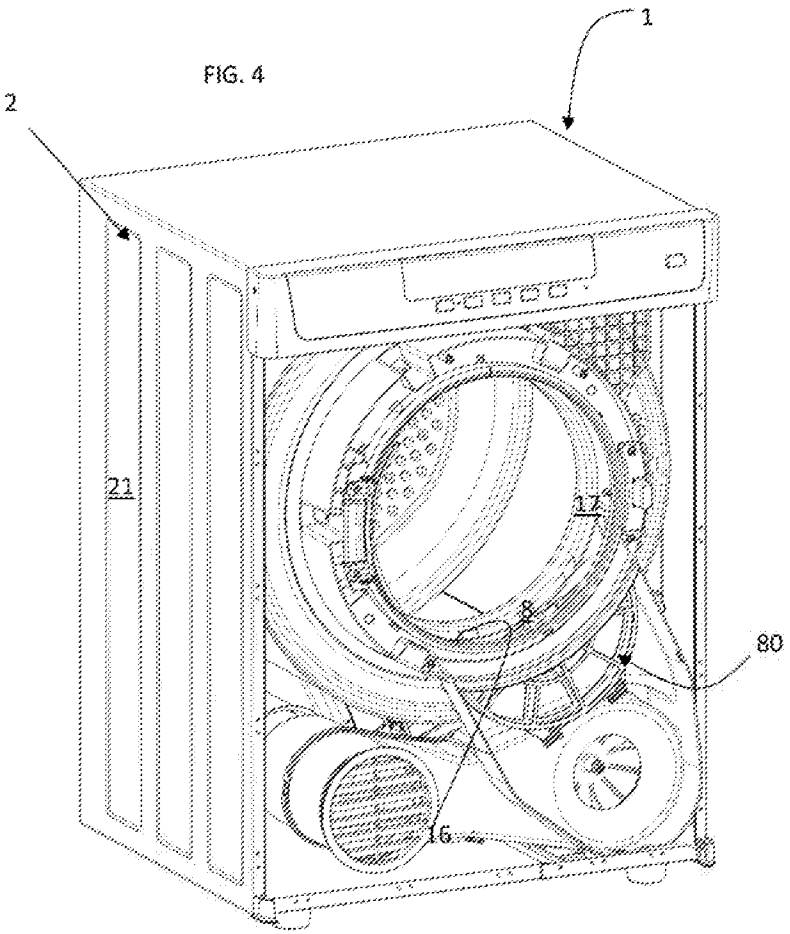
FIG. 4 is a perspective view of the dryer of FIG. 1 and FIG. 3 where the a wall of the cabinet has been removed.
Figure 3:
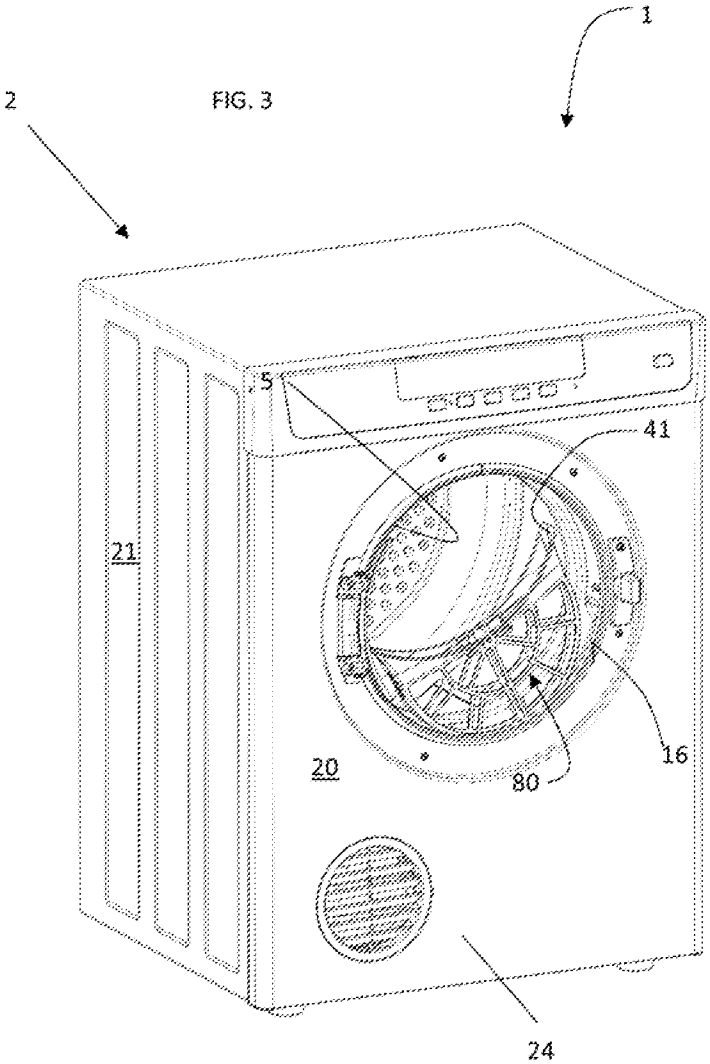
FIG. 3 is a perspective view of a laundry dryer of FIG. 1 in a partially disassembled configuration.
Figure 5:
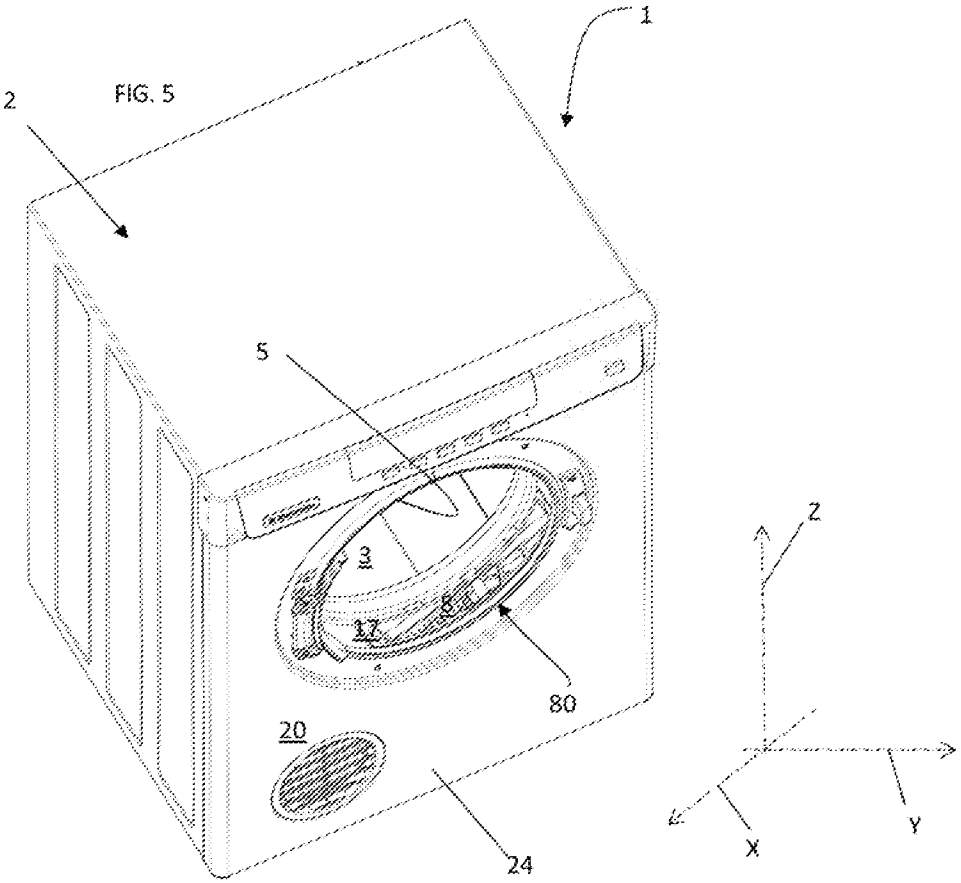
FIG. 5 is a perspective view of the dryer of FIGS. 1, 3 and 4.
Figures 6, 7:
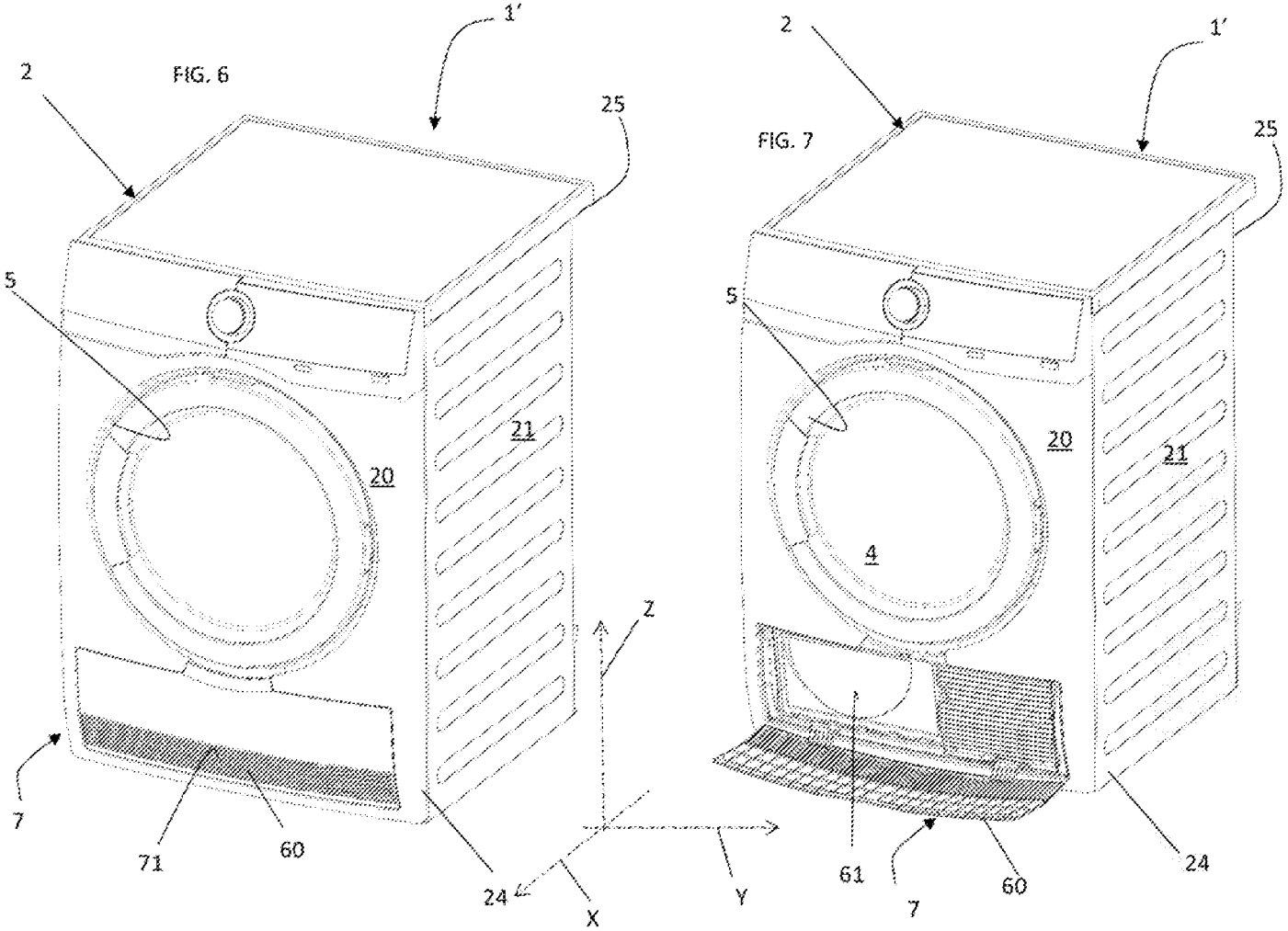
FIG. 6 is a perspective view of another embodiment of the dryer of the invention.
FIG. 7 is a perspective view of the dryer of FIG. 6.

In the dryer of FIG. 3-5, at the rim surface 17 of loading/unloading aperture 5, and more preferably at the inlet 16 of the conduit 18, a seat 8 is formed. The seat extends from the surface 17 into the conduit 18 and it preferably extends downwards into the basement 24.

In the seat 8, a first embodiment of the filter assembly 80 is positioned. The filter assembly 80 can be inserted in a removable manner inside the seat 8. The filter assembly 80 includes an inlet 41 which is positioned substantially at the inlet 16 of the conduit 18, e.g. flush or in very close proximity to the rim surface 17.

The filter assembly 80 is shown in enlarged view and detached from the dryer 1 in FIGS. 11-16.

The filter assembly 80 includes a substantially wedge-shaped filtering cartridge. In detail, the filter assembly 80 includes a frame 31 which comprises a shell or cartridge 112. The shell 112 includes a first part 116 and a second part 118. The first part 116 and the second part 118 of the shell 112 are hinged to each other. For example, the two parts are connected via hinge 124.

The first part 116 and the second part 118 are both defining filtering surfaces. Preferably, the first and second parts are covered or coverable by a filtering net so as to form filtering surfaces. The filtering nets are not explicitly shown in FIGS. 14-17. Each of the filtering nets extends within one plane.

For example, shell 112 includes two filtering surfaces, one per part. For example, the filtering surfaces may be formed by a perforated grid. One portion of the perforated grid may be an integrated part of the first part 116, forming a first filtering surface 32, while the other portion of the perforated grid may be an integrated part of the second part 118 forming a second filtering surface 32'. The portions of the perforated grid are arranged at the first and second outer parts 116 and 118, respectively, opposite to the outer hinge 124. In a closed state of the filter assembly 30', the two filtering surfaces 32, 32' are substantially parallel one to the other and facing each other. An inner volume 40 of the frame 31 is thus defined between the first and second part 116, 118.

Preferably, the shell 112 is positioned inside the seat 8 so that the first and second filtering surface 32, 32' are substantially vertical.

The frame 31 defines an upper part, including inlet 41, and a lower part 42, being substantially vertically oriented.

In total, the filter assembly 80 includes two filtering surfaces 32, 32'.

Further, the filter assembly 80 includes a cleaning device 33 apt to clean the first and the second filtering surface 32, 32' of fluff or other materials deposited on it. The cleaning device 33 comprises a wiper 330 to wipe the first and second filtering surface 32, 32'.

Preferably, the wiper is made of plastic material.

The wiper 330 cleans the filtering surface by means of movement of the same, as detailed below.

The movements performed by the wiper 330 onto the first and second filtering surface 32, 32' of frame 31 are, in the first embodiment of the filter assembly 80, rotation movements, that is, the wiper 330 rotates onto the first and second filtering surface 32, 32' in order to remove fluff or other filtered material from it.

In this embodiment, the wiper 330 includes a rigid element, bar 331, which is inserted inside the frame 31. Preferably, bar 331 is a rigid element defining a longitudinal axis, being extended pronominally in one direction. The bar 331 is hinged to shell 112 at a pivot point 337. Preferably, pivot point 337 is located in the upper part of shell 112, at inlet 41.

Preferably, pivot point 337 is positioned symmetrically with respect to shell 112, that is, it is for example locate at the center of the upper portion.

Preferably, pivot point 337 is positioned at the center of bar 331, so that the bar is divided in two portions by the pivot point. Pivot point 337 thus divides bar 331 in a wiper portion 331' and in a handle portion 338.

Bar 331 defines a longitudinal axis.

Figure 11:
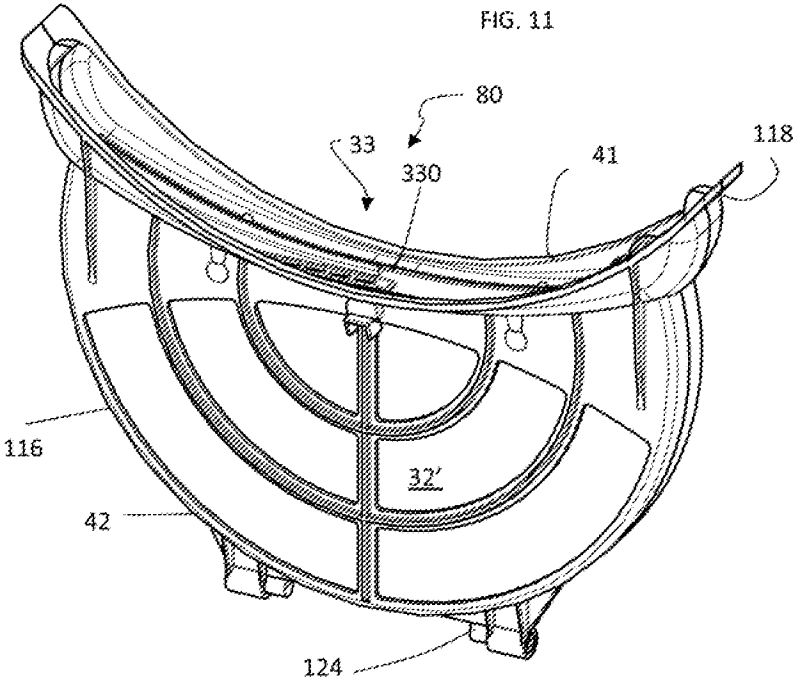
Figure 14:
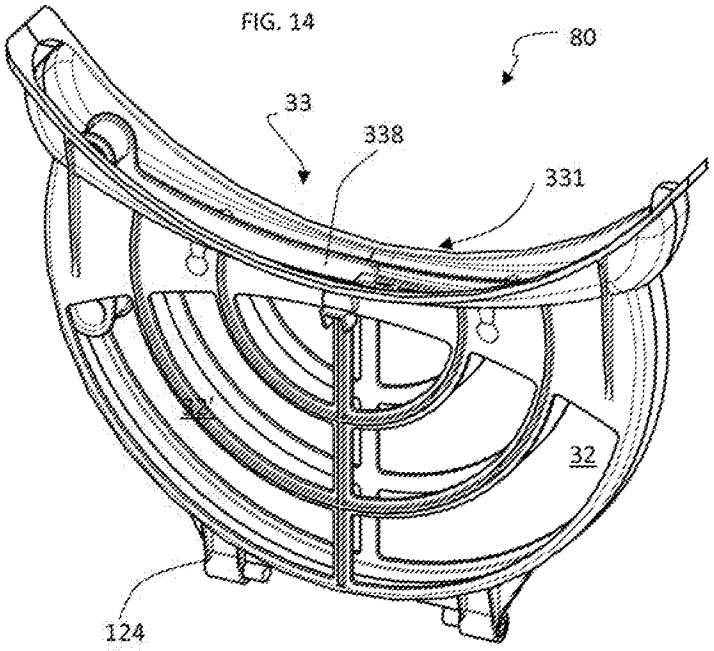
Figure 13:
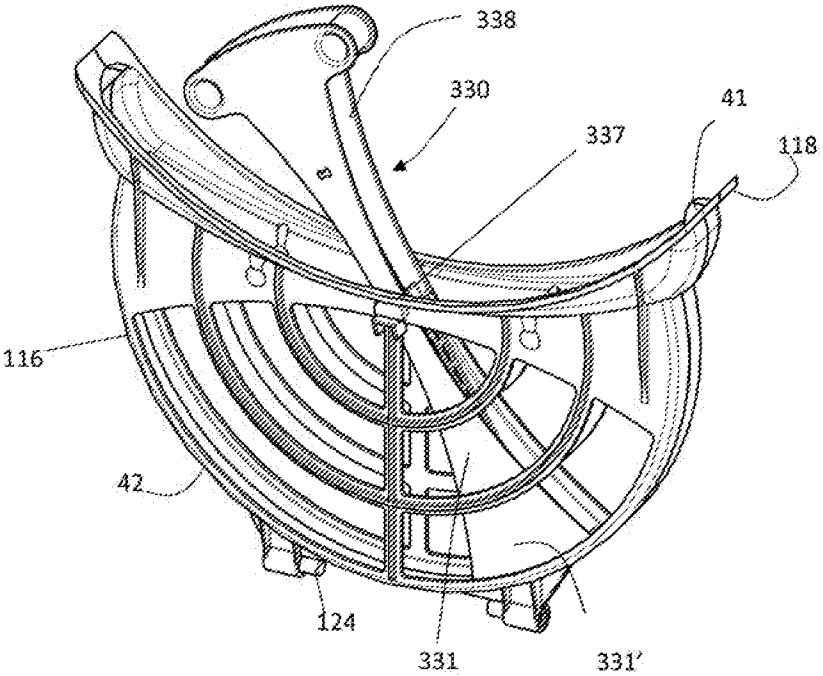

In an initial configuration, bar 331 is preferably disposed substantially horizontally, having a length equal or slightly shorter than the length of the frame 31. In this configuration, bar 331 has its longitudinal axis substantially horizontal and located at the inlet 41 of the frame 31. This configuration is depicted in FIG. 11.

Bar 331 is apt to be rotated around pivot point 337, therefore scratching the first and second filtering surface 32, 32' to remove filtered material from the same. The bar 331 starts at the configuration of FIG. 11, substantially horizontal, and then it rotates of at least 180°, passing through the configuration of FIGS. 12 and 13, to end up again horizontally, in the configuration depicted in FIG. 14. In the latter configuration, the position of handle 338 and wiper portion 331' are inverted with respect to the initial configuration of FIG. 11.

In order to properly clean the surfaces 32, 32', the wiper portion 331' of bar 331 includes parallel opposite walls 335, 336 (i.e., first and second wiping elements), in contact with first and second filtering surfaces 32, 32', respectively, so that, when the wiper 330 rotates in shell 112 from one horizontal configuration to another, the walls 335, 336 scratch first and second filtering surfaces 32, 32'.

In order to stabilize bar 331, walls 335, 336 are preferably connected by a strengthening element. Therefore, preferably wiper portion 331' of bar 331 includes two separated walls 335, 336 connected by a perforated plate 339.

As mentioned above, wiper 330, in addition to bar 331, includes the handle 338. Handle 338 is preferably an elongated element and represent the geometrical continuation of the wiper portion 331'. Preferably, handle 338 is hollow, that is, the elongated element is formed by a perimetral wall and has a through hole in its center.

The handle 338 can be moved between a first and a second configuration, shown in FIGS. 11, 14 (hidden configuration) and FIGS. 12, 13 (visible configuration). The second configuration is in reality a plurality of configurations angularly positioned between the two hidden configurations angularly spaced by 180° which represent the starting and end position of the wiping action.

In the hidden configuration, the wiper 330 is positioned at the upper part of the frame 31, that is, at inlet 41. In this initial or resting configuration, the bar 331 is substantially horizontal, that is, both wiper portion 331' and the handle 338 have a longitudinal axis which is also substantially horizontal. Handle and wiper portion are thus substantially completely hidden in frame 31 and thus in seat 8.

Due to the construction of the wiper portion 331' and of the handle 338, process air entering in conduit 18 from the inlet 16 can flow in the filter assembly 80 due to the fact that both wiper portion 331' and handle 338 are air permeable in a plane perpendicular to the direction of flow of process air.

At the start of a wiping action, that is, at the start of a rotation of the bar 331 around pivot point 337, the handle 338 and wiping portion 331' change position. The wiping portion 331' is inserted into frame 31, while handle 338 protrudes from frame 31 and thus from seat 8. In this configuration therefore, where the axis of bar 331 is tilted with respect to the horizontal axis, the handle 338 protrudes from frame 31 and seat 8. This protrusion continues till the wiper portion 331' reaches again the inlet 41 of frame 31 and the bar 331 is again horizontal.

Therefore, during the whole wiping action, handle 338 protrudes from frame 31 and seat 8.

The handle 338 is moved, i.e. rotated, for at least 180° so that the bar 331 with walls 335, 336, scratches first and second filtering surfaces 32, 32'. The removed fluff is pushed by the wiping portion 331' so that it follows the wiper portion 331' during rotation of the wiper 330 and thus when the bar 331 is again in an horizontal position after a rotation of at least 180° onto surfaces 32, 32', fluff is pulled out of frame 31.

The rotation of bar 331 terminates when the bar 331 reaches again the horizontal position.

Figure 17:
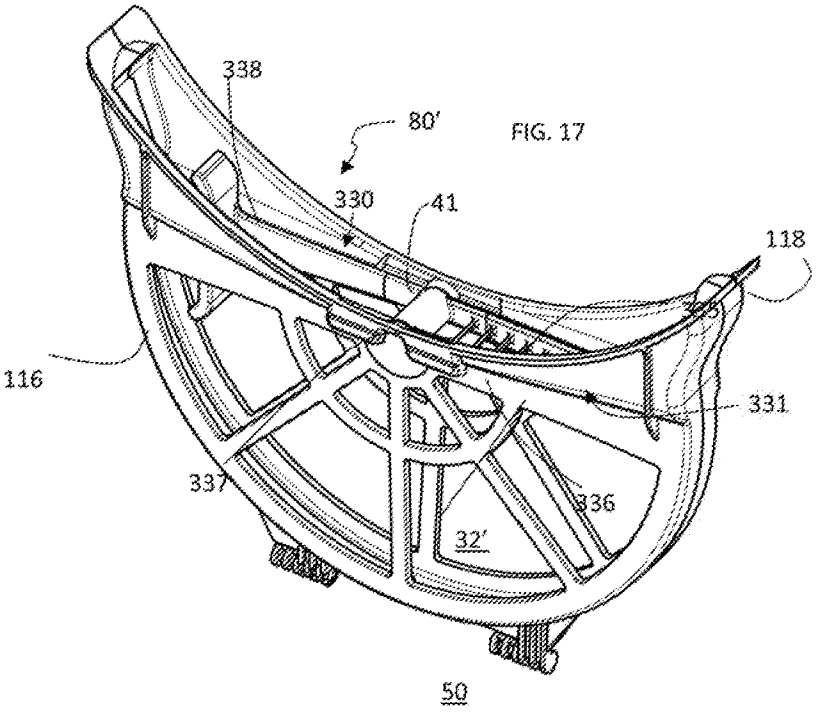
FIGS. 17-18 are two perspective views of a third embodiment of the filter assembly.
Figures 18, 19, 20:
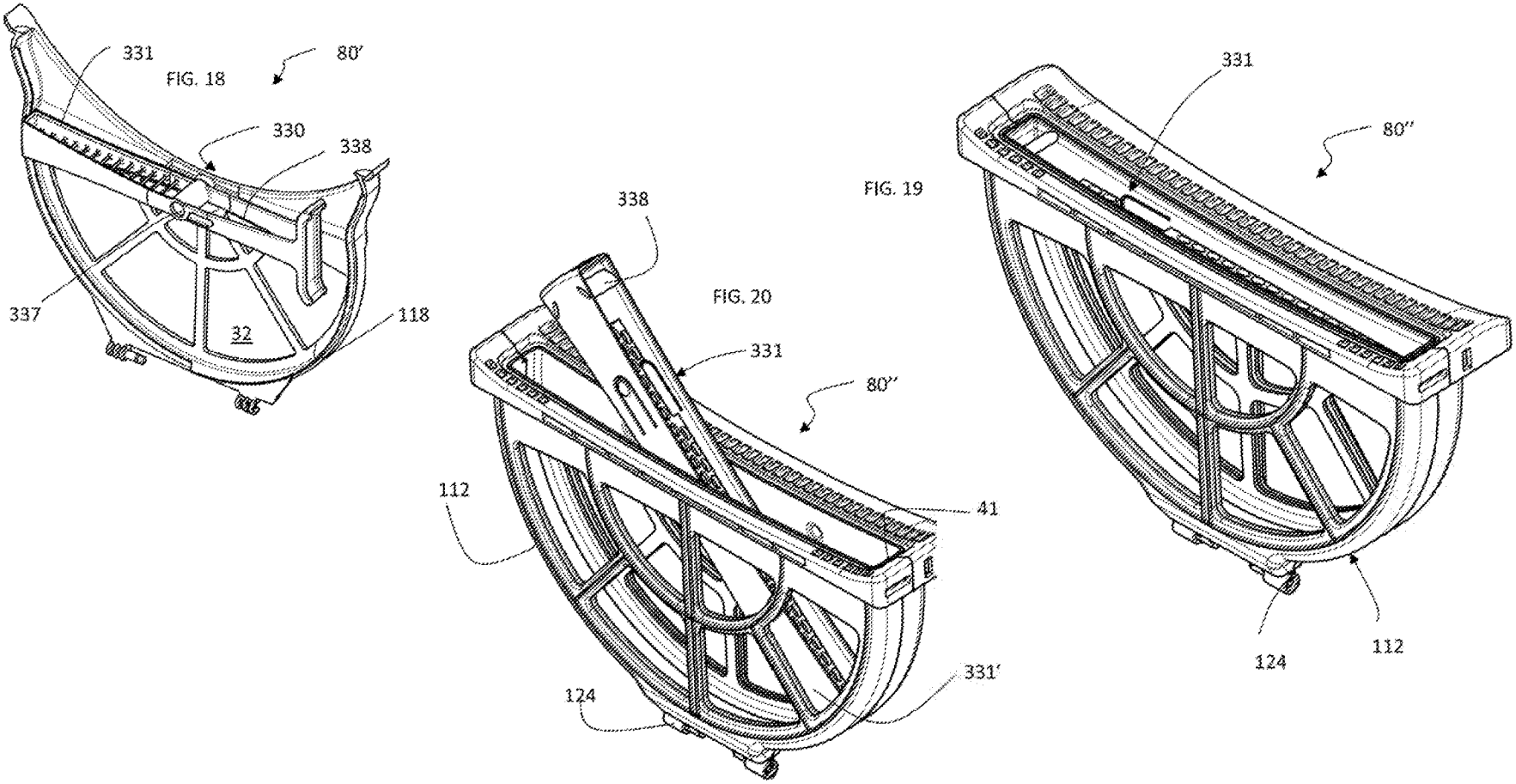
FIGS. 19-22 are perspective views of a fourth embodiment of the filter assembly.
Figure 22:
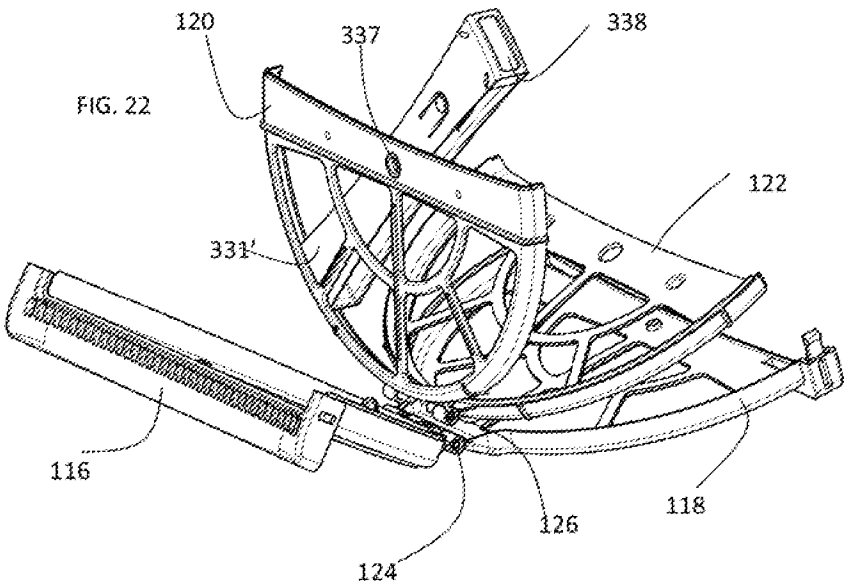
Figure 21:
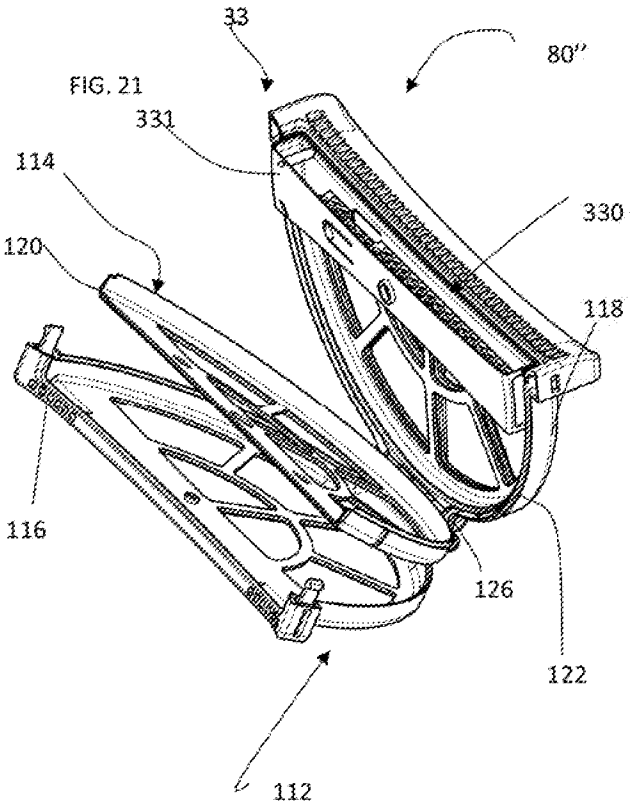
Figure 24:
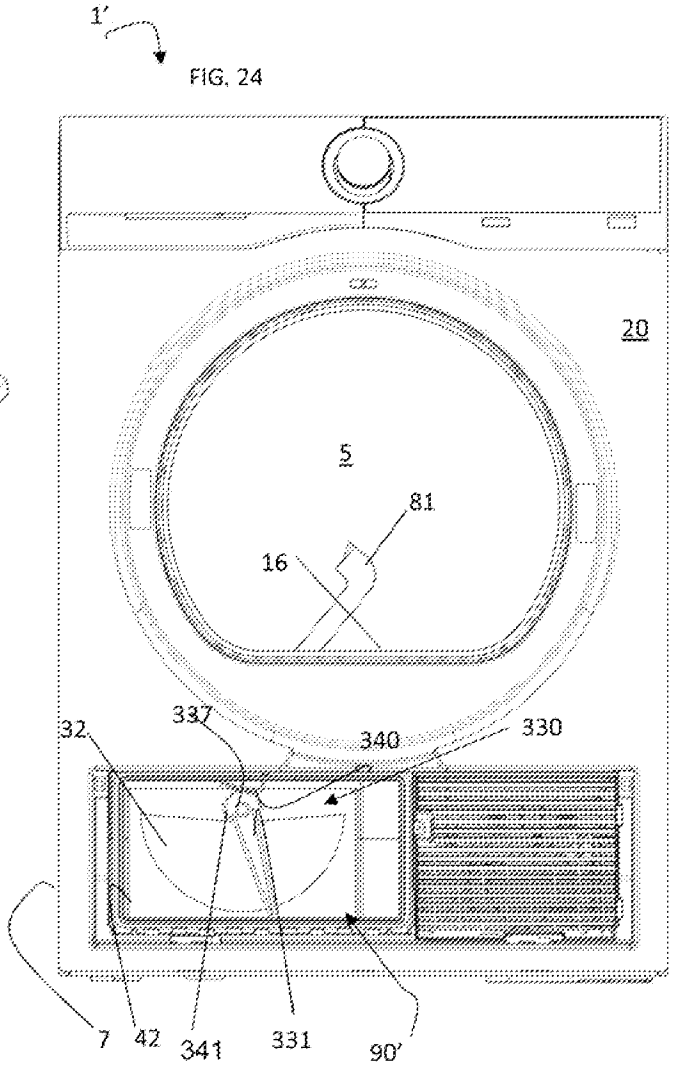
FIG. 24 is a front view of the dryer of FIG. 23.

In a second embodiment of the filter assembly 80' depicted in FIGS. 17, 18, a different shape of handle 338 is depicted. In this configuration, handle 338 is substantially T-shaped so that it can be easily gripped by the user. The remaining characteristics of filter assembly 80' are the same as those of the first embodiment 80.

In a third embodiment, filter assembly 80" is depicted in FIGS. 19-22.

The frame of the filter assembly 80" comprises an outer shell 112 and an inner shell 114. The outer shell 112 includes a first outer part 116 and a second outer part 118, as the shell of filter assembly 80'. The inner shell 114 includes a first inner part 120 and a second inner part 122. The inner shell 114 is hinged inside the outer shell 112. Further, the first outer part 116 and the second outer part 118 of the outer shell 112 are hinged to each other. In a similar way, the first inner part 120 and the second inner part 122 of the inner shell 114 are hinged to each other. Moreover, the first inner part 120 and the second inner part 122 are hinged at the first outer part 116. The outer shell 112 and the inner shell 114 are separately openable. The inner shell 114 is preferably removable from the outer shell 112. For example, the first outer part 116 and the second outer part 118 of the outer shell 112 are connected by an outer hinge 124. The first inner part 120 and the second inner part 122 of the inner shell 114 are connected by an inner hinge 126.

The filter assembly 80" is formed in a book-like manner. The first outer part 116 and the second outer part 118 of the outer shell 112 are ideally comparable with a book cover. The first inner part 120 and the second inner part 122 of the inner shell 114 are ideally comparable with book pages.

The first outer part 116, the second outer part 118, the first inner part 120 and the second inner part 122 are all defining filtering surfaces. The inner portions of said filtering surfaces are covered or coverable by a filtering net in each case. The filtering nets are not explicitly shown in FIGS. 19-22. Each of the filtering nets extends within one plane.

For example, each shell 112, 114 includes two filtering surfaces, one per part. For example, the filtering surface may be formed by a perforated grid. One portion of the perforated grid may be an integrated part of the first outer part 116, forming a filtering surface, while the other portion of the perforated grid may be an integrated part of the second outer part 118 forming another filtering surface. The portions of the perforated grid are arranged at the first and second outer parts 116 and 118, respectively, opposite to the outer hinge 124. In a closed state of the filter assembly 80", the two filtering surfaces are substantially parallel one to the other and facing each other.

In the same manner, a perforated grid may cover the inner shell 114, in particular preferably a first portion covers the first inner part 120 and a second portion covers the second inner part 122 forming other two filtering surfaces (not depicted). When the first inner part and the second inner part are closed, the two filtering surfaces substantially face each other and are parallel to each other. The internal volume between the first and second inner part 120, 122 when the shell is closed is the inner volume 40 of the frame.

Preferably, the inner and outer shells 112, 114 are positioned so that the filtering surfaces are substantially vertical.

In total therefore the filter assembly 80" includes four filtering surfaces.

Wiper 330 of embodiment 80" is identical to the wiper already disclosed with reference to the first embodiment 80. The wiper 330 is hinged with pivot point 337 at the inner shell 114. The bar 331 therefore, with wiper portion 331', wipes the surfaces defined in the first and second inner part 120, 122.

The functioning of the dryer 1 is as follows.

During the drying cycles, the filter assembly 80, 80',80" is positioned in the seat 8 and the wiper 330 is at the top portion of frame 31, extending substantially horizontally at the inlet 41 of frame 31. Handle 338 is also horizontal.

Air in the process circuit can flow in duct 18 due to the air permeable wiper portion 331' and handle 338.

At the end of the drying cycle, the loading/unloading door 4 is opened and the seat 8 at the rim surface 17 is visible. The filter assembly 80, 80', 80" is reachable from the loading/unloading aperture 5. The handle 338 can be moved, that is, it can be rotated around pivot point 337.

The wiper 330 is thus rotated by 180° till the bar 331 reaches again a horizontal configuration. In this way, the first and second filtering surfaces 32, 32' are cleaned by walls 335, 336 and filtered material deposited in them ends up at the upper part of frame 31, transported by wiper portion 331'.

This fluff can be removed by hand.

A different embodiment of the dryer, dryer 1', is now described with reference to FIG. 6-10. Characteristics identical to those of dryer 1 are indicated with the same reference number.

The basement 24 defines a plinth region 7 of the dryer 1'. The plinth region 7 defines a plinth inner volume, that is, the volume inside the cabinet 2 delimited by the cabinet walls and located at the plinth region 7. Preferably the plinth region 7 includes a perforated portion, for example it may include a perforated element 71 on the front wall 20, so as to enable cooling air to be taken in and/or expelled from/to the plinth inner volume, if needed. The plinth region 7 can be provided with portions and/or elements and/or components for supporting operational components of the laundry dryer 1' that are needed for carrying on a laundry drying process on laundry, such as air conduits, motors and so on.

Preferably, the cabinet 2 includes a plinth door 60, such as a rotatable door, to access the plinth inner volume. Preferably, the plinth door 60 is hinged to the cabinet 2 and its rotation axis is substantially horizontal. The plinth door 60 is preferably hinged at the front door 20 of the cabinet 2.

Upon opening the plinth door 60, a further door 61—called first door 61—is present. This first door 61 is accessible only opening the plinth door 60. Preferably this further door 61 is also rotatable along an axis which is substantially horizontal. The first door 61 is situated behind the plinth door 60, such that the plinth 7 is accessible by opening both doors. Further, plinth door 60 and first door 61 are located substantially below the loading/unloading aperture 5 and door 4.

In the first portion 18*a* of duct 18, a filter assembly 90 is positioned. Filter assembly 90 is placed inside the plinth region 7.

In the example illustrated in the enclosed drawings of FIGS. 6-9, the filter assembly 90 is advantageously arranged below the drum 3. Preferably, the filter assembly 90 is contained for its majority within the plinth region 7. Further, the filter assembly 90 is arranged within the first portion 18*a* of the duct of the process air circuit 18, for example below the inlet 16 of the duct itself. The filter assembly 90 according to one embodiment of the invention is depicted in enlarged view in FIGS. 11-14 and includes a first filtering surface 32, in the present embodiment substantially flat, supported by a frame 31. Preferably, the filtering surface 32 is substantially vertical. The frame 31 is in this embodiment a box-like container which forms a part of the first portion 18*a* of the duct and the first filtering surface 32 is a side or wall of the box-like container. The box-like container 31 includes an inlet 41 for the process air, positioned on top of the frame, and surrounding walls which prevent the process air to leave the container with the exception of the wall having the first filtering surface 32. The filtering surface 32 is preferably substantially perpendicular to the inlet 41 of the box-like container. The process air therefore, entering the inlet 41 from above, is forced to perform a 90° turn to change direction from a downwards direction to a substantially horizontal direction and is apt to leave the box-like container via the filtering surface 32. The first filtering surface 32 separates the first portion 18*a* of the duct 18 and the second portion 18*b* of the duct, that is, the first filtering surface 32 puts in fluid communication the first portion 18*a* and second portion 18*b* of the duct 18.

Preferably, the inlet 41 is located at the top of the frame 31. A bottom part 42 is also defined, opposite to inlet 41. The bottom part 42 is not used as an outlet, on the contrary, the outlet from the filter assembly 90 is via the first filtering surface 32, as better detailed below.

The first filtering surface 32 may be in the form of a mesh or net having a proper size to block the typical fluff or particles generated by the laundry. The mesh or filter is not depicted in the drawing otherwise it would cover all other elements. Therefore, in the drawings, first filtering surface 32 appears "open", but it should be interpreted as covered by a net or a mesh, or any other structure apt to filter material flowing in the process air flowing in duct 18.

Preferably, the filtering surface 32 is positioned substantially vertically, or with a small tilt with respect to the vertical direction. The frame 31 thus defines an upper portion, which is the portion of the frame having the top most vertical position (i.e. the portion including the inlet 41).

In the filter assembly 90 of FIGS. 6-10 a single filtering surface 32 is present.

The frame 31 may also comprise a non-filtering surface 37 facing the first filtering surface 32. In this configuration, the frame 31 is defining an inner volume 40 between the first filtering surface 32 and the non-filtering surface 37, but one surface only, the filtering one, is subjected to the flow of process air in order to filter it. The non-filtering surface 37, in other words, in this embodiment, is a wall of the box-like container or frame 31 which is opposite and facing the first filtering surface 32 (which forms another wall of the box like container 31) and directs the flow of process air.

In this embodiment, the non-filtering surface 37 is attached to the first door 61. By opening this further first door 61, the filter assembly 90 can be, for example, rotated from a position where the first filtering surface is substantially vertical to a position where the first filtering surface is tilted with respect to a vertical plane. Further, rotation of the first door 61 causes rotation of the whole filtering assembly 90 which is attached to the door 61.

In this embodiment, therefore, the filtering surface 32 is substantially facing and even more preferably parallel to the first door 61 to which the non-filtering surface 37 is attached. Both first door 61 and filtering surface 32 are preferably vertical, that is, they define substantially vertical planes or planes only slightly tilted with respect to a vertical plane. Between the two surfaces, i.e. non filtering surface 37 and filtering surface 32, the inner volume 40 is defined. Inner volume 40 can be considered as a wiper seat, as detailed below.

In a non-depicted embodiment, the first door 61 is not attached to the non-filtering surface 37. The filter assembly 90 may still be rotatable, for example with a rotation axis also parallel to the horizontal axis around which the plinth door 60 and the first door 61 rotates, however the rotations of the doors 60, 61 and of the filter assembly 30 are independent. Therefore, in order to move into a position in which the first filtering surface is tilted with respect to a vertical plane, in this non depicted embodiment the first door 61 is first rotated and then the filter assembly is rotated as well.

In all embodiments, rotation of the filter assembly, attached or not to the first door 61, implies that the filter assembly 90 reaches a tilted position where the inlet 41 of the frame is directed outwards, that is, the inlet 41 is facing the exterior of the cabinet 2.

Further, the filter assembly 90 includes a cleaning device 33 apt to clean the first filtering surface 32 of fluff or other materials deposited on it. The cleaning device 33 comprises wiper 330.

The wiper 330 of this embodiment is realized as the wiper of the first embodiment 80 and thus not further detailed. The wiper 330 is inserted in the inner volume 40 of the frame 31.

The movements performed by the wiper 330 onto the first filtering surface 32 of frame 31 are rotational movements, that is, the wiper 330 rotates onto the first filtering surface 32 in order to remove fluff or other filtered material from it.

The wiper 330 includes a rigid element, bar 331, forming a wiper portion 331' and handle 338. The bar 331 is preferably disposed substantially horizontally at the end and at the beginning of the wiping action, having a length equal or slightly shorter than the length of the frame 31.

Figure 9:
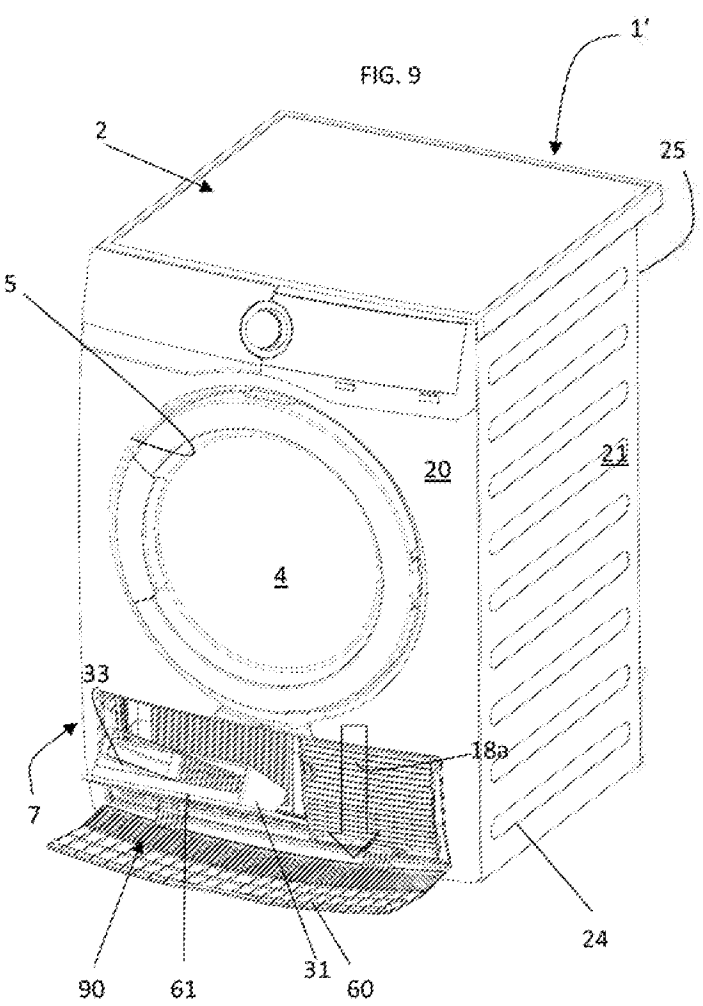
FIG. 9 is a perspective view of the dryer of FIGS. 6-8 including the first embodiment of the filter assembly in a second configuration.
Figure 8:
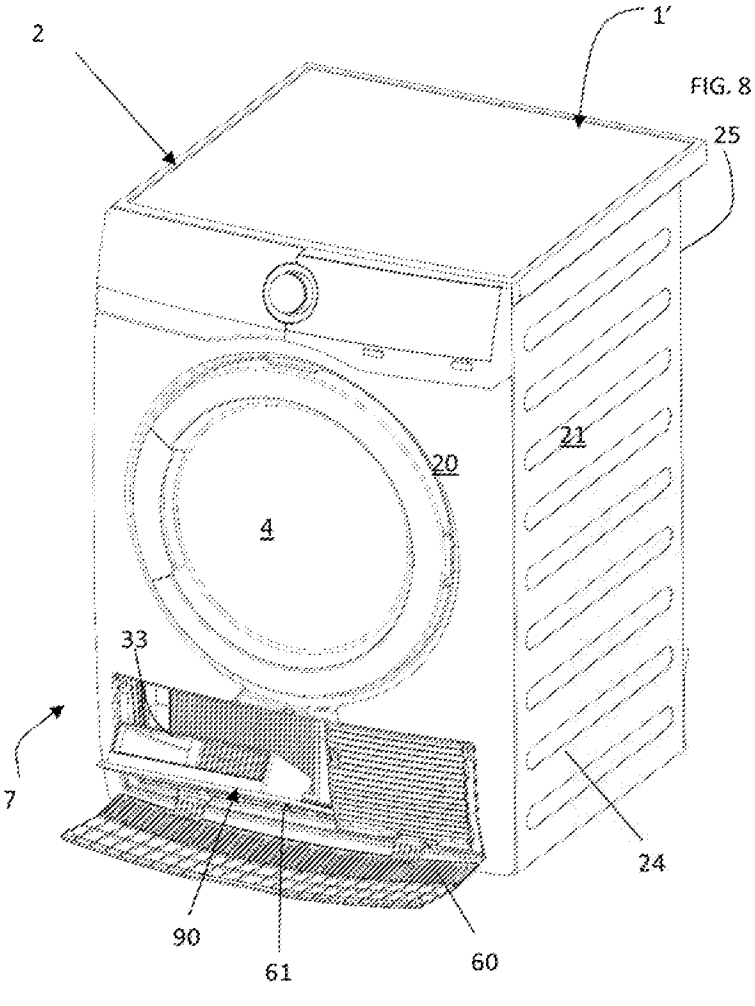
FIG. 8 is a perspective view of the dryer of FIG. 6 or 7 including the first embodiment of the filter assembly in a first configuration.
Figure 10:
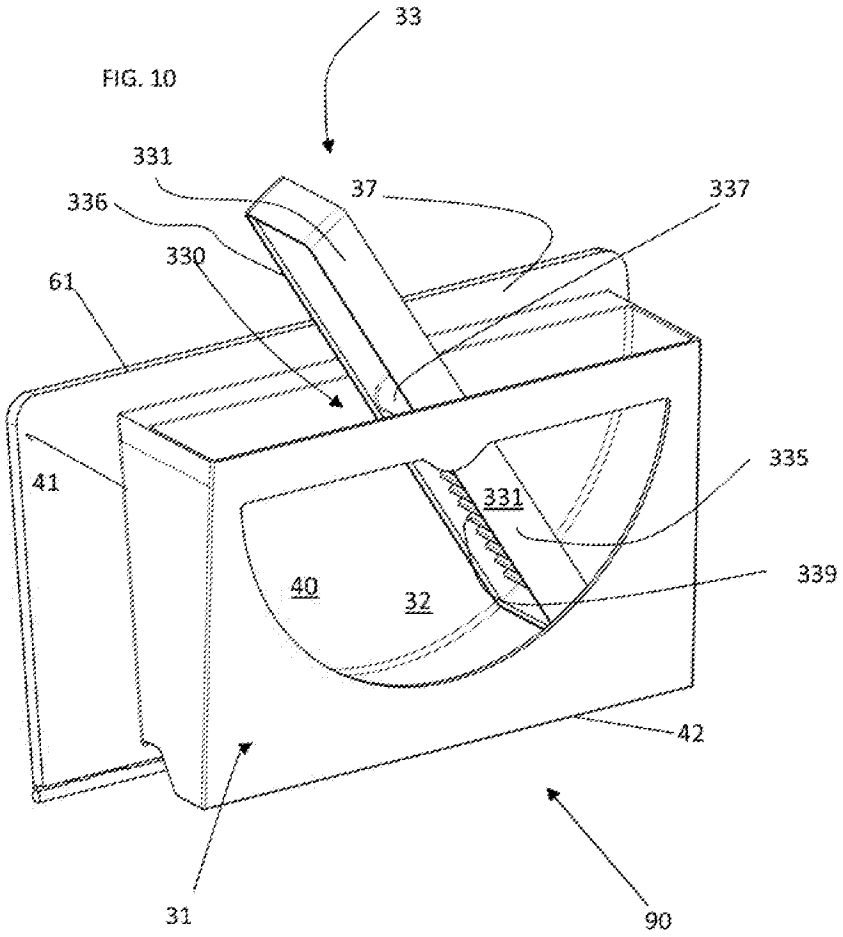
FIG. 10 is a perspective view of the first embodiment of the filter assembly included in the dryer of FIGS. 6-9 in the configuration of FIG. 9.
Figure 12:
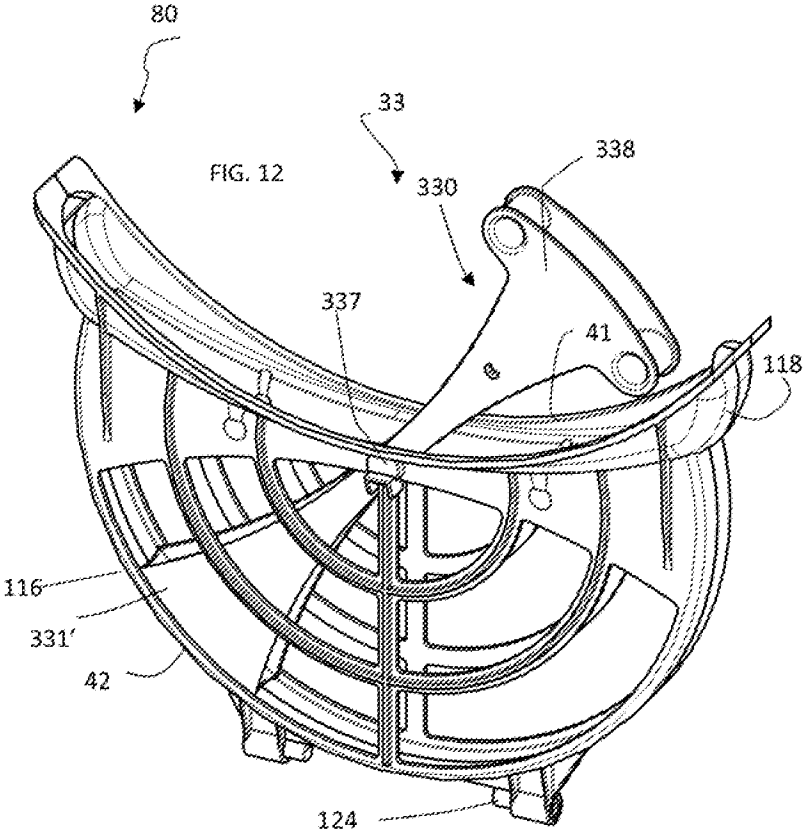
FIGS. 11-14 are perspective views of a second embodiment of the filter assembly in different configurations.

Bar 331 is apt to be rotated by at least 180°, therefore scratching the first filtering surface 32 to remove filtered material from the same. In FIG. 8, the bar 331 is shown horizontally at the top or upper part having inlet 41 of the frame 31. In FIGS. 10 and 9, the bar 331 is shown during a wiping action, inclined with respect to the horizontal axis.

The bar 331 is hinged to frame 31, at its inlet 31, by pivot point 337.

In order to properly clean the surface 32, bar 331 includes parallel opposite walls 335, 336, in contact with first filtering surfaces 32, and non-filtering surface 37, so that, when the wiper 330 rotates, in frame 31, the wall 335 scratches first filtering surface.

In order to stabilize bar 331, walls 335, 336 are preferably connected by crosspieces 339. Therefore, preferably bar 331 includes two separated walls 335, 336 connected by crosspieces 339 and separated by an empty gap.

The handle 338 can be moved between a first and a second configuration, shown in FIG. 8 (horizontal configuration) and FIGS. 9 and 10 (tilted configuration).

In the horizontal configuration, the wiper 330 is horizontally positioned at the upper part of the frame 31, that is, at inlet 41. In this configuration, the handle 338 is substantially horizontal. Handle 338 is thus preferably completely hidden in frame 31, inside inner volume 40.

Due to the construction of the bar 331 and of the handle 338, process air entering in conduit 18 from the inlet 16 can flow in the filter assembly 90 due to the fact that both bar 331 and handle 338 are air permeable in a plane perpendicular to the direction of flow of process air.

In a wiping action, the handle 338 is rotated around the pivot point 337, so that wiper portion 331' rotates onto first filtering surface 32.

In this configuration, handle 338 protrudes from frame 31.

In order to perform a wiping action, the handle is then moved, translated downwards, so that the bar 331 with walls 335, 336, scratches first filtering surfaces 32.

The translation of bar 331 terminates when the bar 331 reaches again the horizontal configuration.

The operation of the filter assembly 90 is as follows.

During the drying cycle, or outside a wiping action, the wiper 330 is positioned inside the frame 31, inserted in the inner volume 40. Bar 331 is horizontally arranged substantially at the inlet 41 of the frame 31. The whole assembly is located within the plinth inner volume and it forms a portion of the conduit 18. The first filtering surface 32 filters the flowing process air in circuit 18 and filtered material accumulates on it. The first filtering surface 32 is preferably substantially vertical of with a large vertical component. Handle 338 is horizontal and it does not extend outside the frame 31 or volume 40 but it is completely contained therein.

In this configuration, inlet 16 of the conduit 18 and inlet 41 of the filter assembly 90 are one below the other, being part of the same conduit.

At the end of a drying cycle, or every time there is a need of cleaning the first filtering surface 32 of the filter assembly from the filtered material which has accumulated during the drying cycle, the plinth door 60 is opened. The opening takes place preferably with a rotation of the plinth door 60 around a horizontal axis. This configuration is shown in FIG. 8. Behind the plinth door 60, the first door 61 is present. Attached to the first door, the filter assembly 90 is located. Alternatively, the filter assembly is freely rotatable around a horizontal axis.

Opening the first door 61, that is, preferably rotating the same around a horizontal axis, removes the assembly 90 from the inner volume of the plinth 7 and the inlet 41 of the frame 31 is oriented outwards (see FIG. 8).

In order to wipe the first filtering surface 32, the wiper is actuated. The actuation is performed for example by hand. The handle 338 is rotated so that the wiping portion 331' starts the rotation onto the first filtering surface 32. This rotation causes a wiping of the first filtering surface 32.

The fluff and lint is thus transported to the inlet 41 by the wiper portion 331' and there possibly removed, for example by the user.

A fifth embodiment of the filter assembly 90' is depicted in FIGS. 23-28.

In this embodiment, characteristics identical to those of the fourth embodiment are referred with the same reference numerals.

Filter assembly 90' includes a frame 31 having the same characteristics as in the fourth embodiment.

Frame 31 has a box shape as in the fourth embodiment of the filter assembly 90. The first filtering surface is preferably vertical and it is preferably one of the walls of the box defined by the frame 31. For other characteristics of frame 31 and filtering surface 32, reference is made to the fourth embodiment of the filter assembly 90.

The filter assembly 90' further comprises a wiper 330 apt to wipe the first surface 32. The wiper 330 includes a pointer or hand-like element 331 pivoted at a pivot point 337. The wiper therefore can only perform rotations or oscillations around pivot point 337. Pivot point is preferably attached to the non-filtering surface 37 of the frame 31, more preferably it is located centrally, that is, in a location along an axis of the frame, so that the wiper can wipe surface 32 symmetrically. Preferably, pivot point 337 is positioned at the upper portion of frame 31. Wiper 330 thus can be rotated onto the first filtering surface 32, from a position in which the pointer is substantially horizontal, to a position where the pointer is again horizontal but placed at the opposite side of the pivot point 337 with respect to the starting point. Preferably, a rotation of at least 180° of the pointer with respect to the pivot point 337 is performed in order to wiper first filtering surface 32. Preferably, the pointer is long enough so that the whole first filtering surface is wiped. Preferably, the length of the pointer is equal or slightly smaller than the height of the frame.

Figure 23:
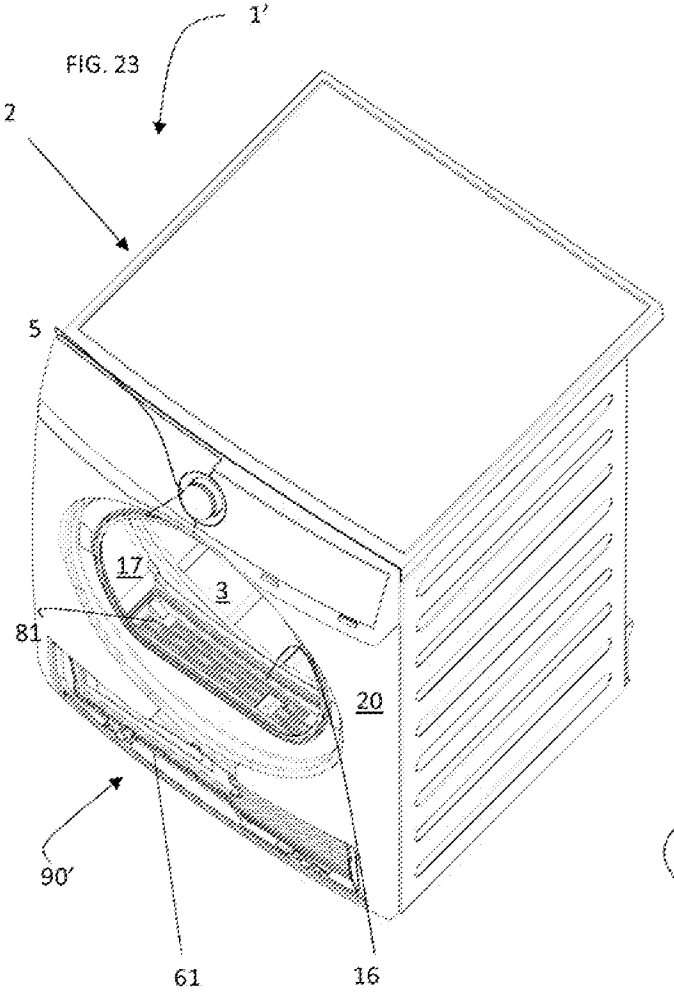
FIG. 23 is a perspective view of a dryer including a fifth embodiment of the filter assembly.
Figures 25, 26:
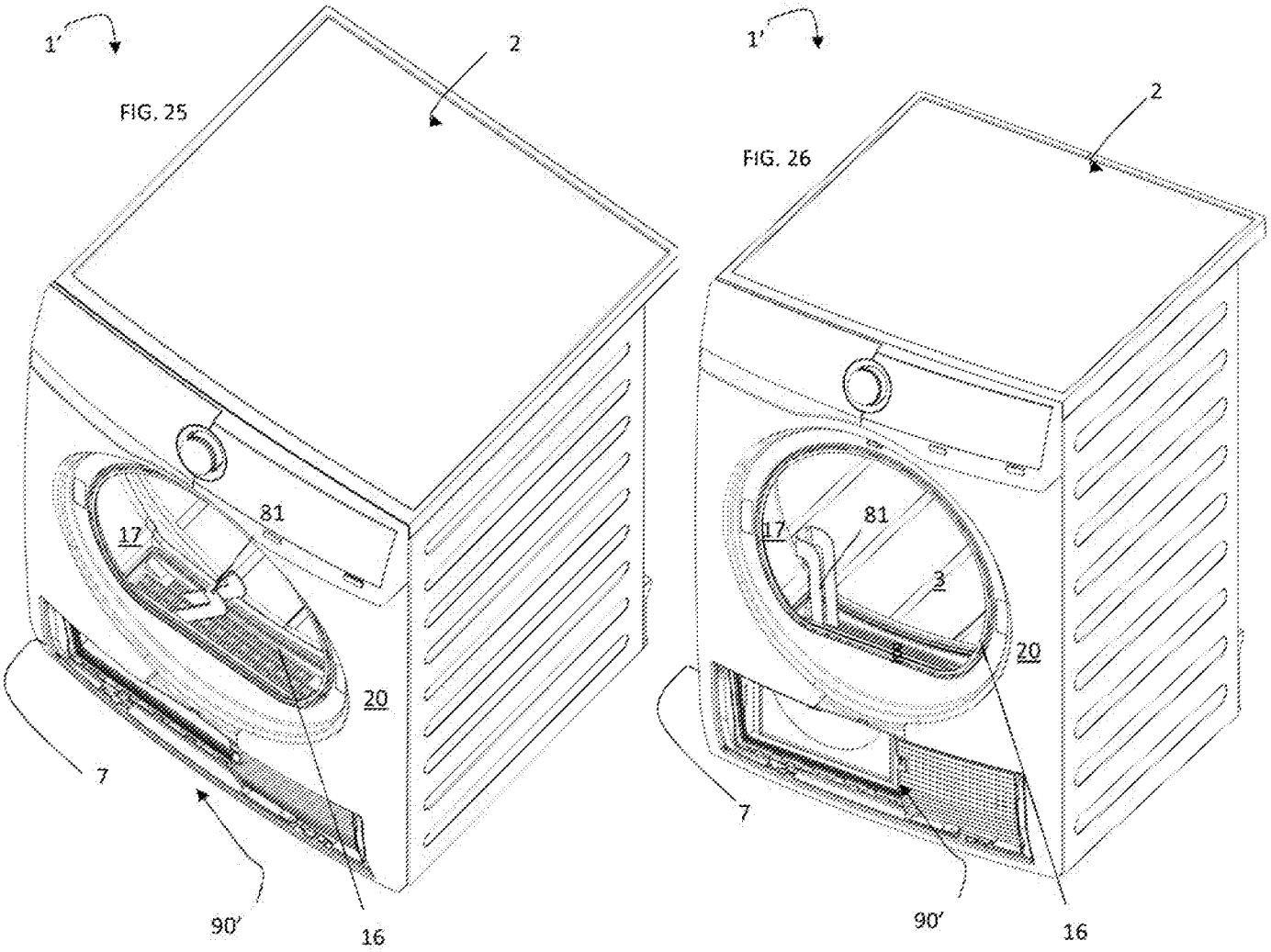
FIG. 25 and FIG. 26 are perspective views of the dryer including the fifth embodiment of the filter assembly.
Figure 27:
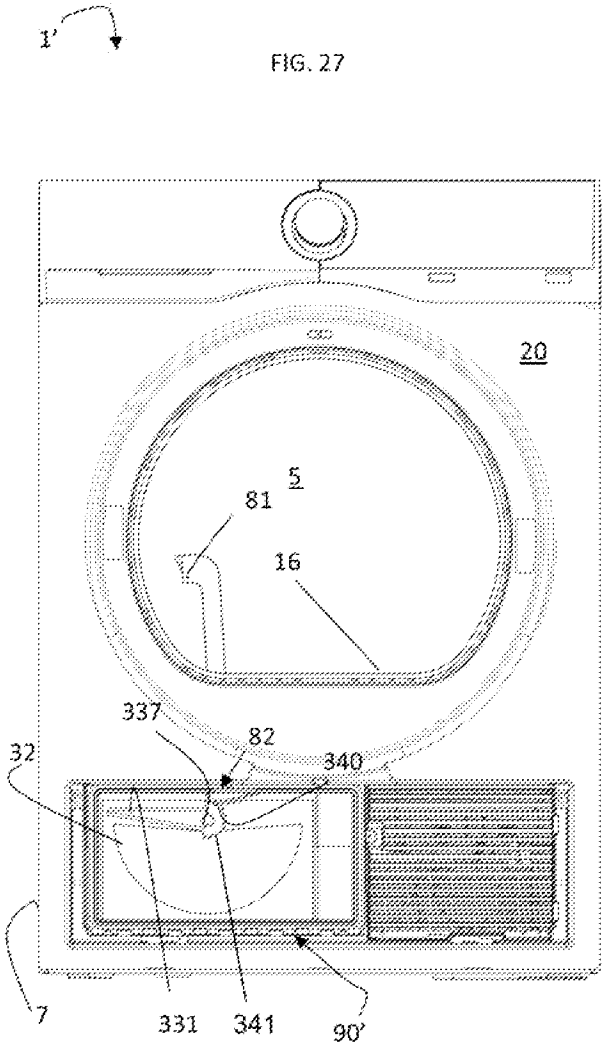
FIG. 27 is a front view of the dryer of FIG. 26.

The configuration in which pointer 331 is on one side of the pivot point 337 substantially horizontal is depicted in FIG. 27. The configuration with the wiper rotated of 180° is depicted in FIG. 23, although the wiper 330 is not visible.

Further, the filter assembly 90' comprises an actuator 81. The actuator is positioned in seat 8 realized at the inlet 16 of duct 18. When not actuated, preferably, the actuator 81 remains completely contained within seat 8, realized at the rim surface 17 of the loading/unloading opening 5. When actuated, the actuator 81 protrudes from seat 8.

The actuator 81 includes a leverage. The leverage is rotatable around a pivot point 88. When the actuator 81 is not operated, the leverage is laying with its longitudinal axis substantially horizontal within the seat 8. In this configuration, the pointer 331 of wiper 330 is substantially horizontal at one side of the pivot point 337. When actuated, the leverage is rotated around pivot point 88. The leverage protrudes from the seat during the rotation, when its longitudinal axis is not any more horizontal. At the end of the motion, when the leverage has reached a position in which its longitudinal axis is substantially vertical, preferably the pointer is again substantially horizontal on the opposite side with respect to the pivot point 337 when compared to the starting position.

The leverage includes a manually operable handle.

Figure 28:
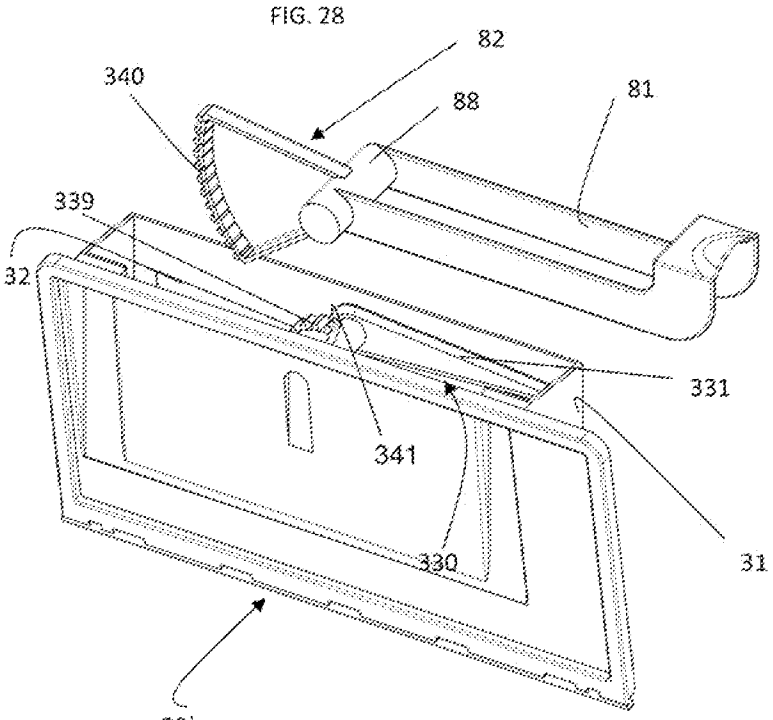
FIG. 28 is an enlarged view of the fifth embodiment of the filter assembly.

The configuration in which the leverage is substantially horizontal together with an horizontal pointer 331 is better visible in FIG. 28 where an enlarged view of the filter assembly 90' is shown.

The actuator 81 is connected to the wiper 330 by means of a connector 82, including a first gear portion 340 connected to the actuator and a second gear portion 341 connected to the pivot point 337. The first and second gear portions 340, 341 are so configured that they can mesh one into the other. When the actuator 81 is resting, that is, it is not actuated (rotated), the pivot points 88 and 337 are preferably positioned one above the other, with the pivot point 88 of the leverage located higher. The distance between the two pivot points is such that rotations of the leverage around the pivot point 88 causes meshing of the first gear portion 340 in the second gear portion 337 and thus consequent rotation of the wiper 330. When the leverage is rotated, the first gear portion 340 engages with the gear portion 341 and the pointer rotates accordingly, due to the fact that the gear portion surrounds the pivot point 337.

The actuation of the actuator 81 includes the following movements. A first movement is a rotation of the actuator 81, that is, rotation of leverage around pivot point 88, so that the first gear portion 340 engages with the second gear portion 341. Due to this connection, the wiper 330 is rotated. The leverage is rotated till the leverage is substantially vertical. In this configuration, preferably the wiper is again horizontal. A second movement takes place when the leverage is brought back to the resting horizontal position. The wiper 330 rotates again due to the meshing of the first and second gear portions. Rotations of the actuator 81 thus results in rotations of the wiper 330.

The operation of the filter assembly 90' is as follows.

When no wiping is needed, the actuator 81 is positioned in the seat 8 and does not protrude from the same (see FIG. 23). The leverage is in a rest state and substantially horizontal.

The wiper 330 is located on one side of the pivot point 337 substantially horizontally. In this configuration door 61 cannot be opened. The filtering surface 32 is substantially vertical (see FIGS. 26 and 27).

The loading/unloading door 4 is opened, for example to download laundry from the drum 3. At the end of the download, the user may actuate the actuator 81, rotating the leverage. By rotating the actuator, the connector 82 attached to the wiper 330 and to the actuator 81 rotates the wiper 330 so that the pointer 331 scrapes the first filtering surface 32 from one side to the other in a 180° rotation. The end position of the wiper 330 is reached when it rest horizontally on the other side of the pivot element.

The wiper 330 may be totally extracted from the seat 8. In this configuration, the door 61 can be opened and the frame 31 may be reached. The opening of the first door 61 can take place also for example for maintenance purposes.

Further, before starting a new drying cycle, the wiper 330 needs to be reinserted in the frame 31.

The above configuration in which the wiper 330 is actuated by means of an actuator via a connector can be realized also using a filter assembly not attached to door 61.

The invention claimed is:

1. A laundry dryer comprising:

a cabinet;

a drum rotatably supported in the cabinet;

a duct defining a flow passage for process air exiting the drum;

a filter assembly positioned at least partially in the duct so as to filter process air flowing therein, the filter assembly comprising:

a frame, a filter supported by the frame and defining a first filtering surface, and a cleaning device configured to clean the first filtering surface;

wherein the cleaning device comprises:

a wiper seat, a wiper portion configured to wipe the first filtering surface, and a manually operable handle portion connected to the wiper portion, wherein the wiper portion mounted to pivot relative to the frame so as to rotate around an axis, to be movable from a first resting position wherein the manually operable handle portion is substantially completely housed in the wiper seat to a plurality of wiping positions in which the wiper portion wipes the first filtering surface and wherein, in at least one of the wiping positions, the manually operable handle portion protrudes from the wiper seat, and wherein the manually operable handle portion is operable to perform the transition from the first resting position to any of the wiping positions.

2. The laundry dryer according to claim 1, wherein the manually operable handle portion is movable in relation to the wiper portion from a retracted configuration allowing the cleaning device to be placed in the first resting position to an extended configuration allowing the cleaning device to be manually moved in at least one of the wiping positions.

3. The laundry dryer according to claim 2, wherein the manually operable handle portion is foldable relative to the wiping portion.

4. The laundry dryer according to claim 1, wherein the manually operable handle portion is integral to the wiper portion.

5. The laundry dryer according to claim 1, wherein the filter further comprises a second filtering surface facing and spaced from the first filtering surface, and the wiper portion comprises a first wiping element in contact with the first filtering surface when the cleaning device is in any of the wiping positions and a second wiping element in contact with the second filtering surface when the cleaning device is in any of the wiping positions.

6. The laundry dryer according to claim 5, wherein the wiper portion includes a connector extending between the first wiping element and the second wiping element, the connector being air-permeable in a given direction.

7. The laundry dryer according to claim 6, wherein the connector includes any of: a perforated wall, and a first and a second crosspiece connecting the first and second wiping elements at respective first and second ends thereof.

8. The laundry dryer according to claim 6, wherein the connector in the first resting position includes a surface which is substantially perpendicular to the process air flow.

9. The laundry dryer according to claim 5, wherein the filter assembly defines the wiper seat between the first and the second filtering surfaces.

10. The laundry dryer according to claim 1, wherein the frame includes a lower portion, having a curved shape.

11. The laundry dryer according to claim 10, wherein the wiper portion includes a distal end located distally from the axis, the distal end being in contact with the lower portion of the frame in any of the wiping positions.

12. The laundry dryer according to claim 1, wherein the cleaning device is pivotally attached to the frame at a pivot point and the pivot point geometrically separates the handle portion from the wiper portion of the cleaning device.

13. The laundry dryer according to claim 1, wherein the wiper seat is positioned in the cabinet downstream of the drum in a flowing direction of the process air.

14. The laundry dryer according to claim 13, wherein the filter assembly is removably housed in the wiper seat.

15. The laundry dryer according to claim 13, wherein the cabinet includes a loading/unloading aperture to allow access to the drum and a loading/unloading door to close the loading/unloading aperture, and an inlet of the wiper seat is formed on a surface delimiting the loading/unloading aperture.

16. The laundry dryer according to claim 1, wherein the filter assembly comprises an openable shell-like structure.

17. The laundry dryer according to claim 1, wherein the cabinet includes a loading/unloading aperture, a loading/unloading door configured to selectively close the loading/unloading aperture, and an openable further door, separate from the loading/unloading door, and an openable portion of the filter assembly is attached to and movable with the openable further door.

18. The laundry dryer according to claim 1, wherein the cleaning device is further movable to a second resting position that is spaced from the first resting position, with the plurality of wiping positions being located between the first resting position and the second resting position.

19. The laundry dryer according to claim 18, wherein the first resting position is separated from the second resting position by an angle of at least 100° about the axis.

20. The laundry dryer according to claim 1, wherein the cabinet comprises a base portion of the cabinet, wherein:

the base portion of the cabinet defines an inner base portion volume within the cabinet;

the filter assembly is located within the inner base portion volume;

an actuator is located in the cabinet and configured to force the cleaning device to perform rotational movement with respect to the frame when actuated, the actuator including the manually operable handle portion and being located remote from the filter assembly; and a connecting element connecting the actuator and the wiper portion, and configured to transfer movements of the actuator into rotational movement of the wiper portion.

21. The laundry dryer according to claim 20, wherein the actuator comprises one or more of a gear rack and a rotatable gear.

* * * * *